US012692806B2

(12) United States Patent
Zoeller

(10) Patent No.: US 12,692,806 B2
(45) Date of Patent: Jul. 28, 2026

(54) METHOD FOR OPERATING A BURNER OF A MOTOR VEHICLE

(71) Applicant: Mercedes-Benz Group AG, Stuttgart (DE)

(72) Inventor: Herbert Zoeller, Stuttgart (DE)

(73) Assignee: Mercedes-Benz Group AG, Stuttgart (DE)

( * ) Notice: Subject to any disclaimer, the term of this patent is extended or adjusted under 35 U.S.C. 154(b) by 25 days.

(21) Appl. No.: 18/551,792

(22) PCT Filed: Mar. 17, 2022

(86) PCT No.: PCT/EP2022/057002

§ 371 (c)(1),
(2) Date: Sep. 21, 2023

(87) PCT Pub. No.: WO2022/200171

PCT Pub. Date: Sep. 29, 2022

(65) Prior Publication Data

US 2024/0167406 A1 May 23, 2024

(30) Foreign Application Priority Data

Mar. 25, 2021 (DE) ..... 10 2021 001 587.8

(51) Int. Cl.
*F01N 3/025* (2006.01)
*F01N 3/20* (2006.01)
(Continued)

(52) U.S. Cl.
CPC ..... *F01N 3/025* (2013.01); *F01N 3/2033* (2013.01); *F01N 3/32* (2013.01); *F01N 3/36* (2013.01);
(Continued)

(58) Field of Classification Search
CPC ..... F01N 2240/14; F01N 2470/24; F01N 2610/1453; F01N 3/025; F01N 3/2033; F01N 3/32; F01N 3/36; F01N 9/00
See application file for complete search history.

(56) References Cited

U.S. PATENT DOCUMENTS 4,602,571 A 7/1986 Chadshay
5,826,428 A 10/1998 Blaschke
(Continued)

FOREIGN PATENT DOCUMENTS

CN 104024733 A 9/2014
DE 10 2006 015 841 B3 8/2007
(Continued)

OTHER PUBLICATIONS

PCT/EP2022/057002, International Search Report dated Jul. 21, 2022 (Two (2) pages).
(Continued)

*Primary Examiner* — Anthony Ayala Delgado
(74) *Attorney, Agent, or Firm* — Crowell & Moring LLP

(57) ABSTRACT

A method for operating a burner where the burner includes a combustion chamber in which a mixture comprising air and a liquid fuel is to be ignited and an inner swirl chamber that can be flowed through by a first part of the air. The swirl chamber has a first outflow opening that can be flowed through by the first part of the air flowing through the inner swirl chamber. The burner includes an introduction element that has an exit opening that can be flowed through by the liquid fuel and is arranged in the inner swirl chamber where the liquid fuel is able to be introduced into the inner swirl chamber via the exit opening by the introduction element and where the first outflow opening is also able to be flowed through by the liquid fuel that has exited the introduction element via the exit opening.

10 Claims, 11 Drawing Sheets

(51) Int. Cl.

| | |
|---|---|
| ***F01N 3/32*** | (2006.01) |
| ***F01N 3/36*** | (2006.01) |
| ***F01N 9/00*** | (2006.01) |

(52) U.S. Cl.
CPC ..... *F01N 9/00* (2013.01); *F01N 2610/1453* (2013.01)

(56) References Cited

U.S. PATENT DOCUMENTS

| | | | | |
|---|---|---|---|---|
| 7,779,636 | B2 * | 8/2010 | Buelow | F23R 3/14 60/742 |
| 2006/0283187 | A1 | 12/2006 | Broadbent | |
| 2010/0269506 | A1 * | 10/2010 | Nonaka | F23D 11/386 60/742 |
| 2011/0183274 | A1 | 7/2011 | Bahn | |
| 2014/0318107 | A1 | 10/2014 | Tsumagari et al. | |
| 2019/0275862 | A1 * | 9/2019 | Peitz | B60H 1/2212 |

FOREIGN PATENT DOCUMENTS

| | | | |
|---|---|---|---|
| EP | 0 879 992 | A1 | 11/1998 |
| EP | 1 731 837 | A2 | 12/2006 |
| WO | WO 2010/022747 | A1 | 3/2010 |

OTHER PUBLICATIONS

German-language German Office Action issued in German application No. 10 2021 001 587.8 dated Oct. 29, 2021 (Six (6) pages).
German-language German Office Action issued in German application No. 10 2021 001 587.8 dated Mar. 18, 2022 (Six (6) pages).
U.S. Patent Application, "Burner for a Motor Vehicle and Motor Vehicle Having at Least One Such Burner", filed Sep. 21, 2023, Inventor Herbert Zoeller.
U.S. Patent Application, "Burner for a Motor Vehicle", filed Sep. 21, 2023, Inventor Herbert Zoeller.
Chinese-language Office Action issued in Chinese Application No. 202280024630.5 dated Jan. 19, 2026 (6 pages).

* cited by examiner

METHOD FOR OPERATING A BURNER OF A MOTOR VEHICLE

BACKGROUND AND SUMMARY OF THE INVENTION

The invention relates to a method for operating a burner of a motor vehicle having an exhaust gas tract that can be flowed through by exhaust gas of an internal combustion engine.

Motor vehicles having internal combustion engines and exhaust gas systems, which are also described as exhaust gas tracts, are known from the general prior art and in particular from series vehicle construction. The respective exhaust gas tract can be flowed through by exhaust gas of the respective internal combustion engine, also described as an internal combustion motor. In some operating states or operating situations of the respective internal combustion engine, a high temperature of the exhaust gas can be desirable, for example to be able to quickly heat and/or keep warm an exhaust gas aftertreatment device arranged in the exhaust gas tract, wherein, however, the temperature of the exhaust gas is only insufficiently high in these operating states or situations.

DE 10 2006 015 841 B3 discloses a burner of a motor vehicle having an exhaust gas tract that can be flowed through by exhaust gas of an internal combustion engine. The burner has a combustion chamber, in which a mixture comprising air and a liquid fuel is to be ignited and thus to be combusted. An inner swirl chamber that can be flowed through by a first part of the air and causes a turbulent flow of the first part of the air is provided. An introduction element having an exit opening is provided in the inner swirl chamber, by means of which introduction element fuel can be introduced into the inner swirl chamber via the exit opening. The inner swirl chamber is surrounded by an outer swirl chamber than can be flowed through by a second part of the air and causes a turbulent flow of the second part of the air. The inner swirl chamber has a first outflow opening and the outer swirl chamber has a second outflow opening, via which the parts of the air and the fuel can be introduced into the combustion chamber.

The object of the present invention is to create a method for operating a burner of a motor vehicle, such that a particularly advantageous operation of the burner can be realized.

A first aspect of the invention relates to a method for operating a burner of a motor vehicle having an exhaust gas tract that can be flowed through by exhaust gas of an internal combustion engine, also described as an internal combustion motor, of a motor vehicle. This means that in its completely produced state, the motor vehicle, which can preferably be designed as a motor car and particularly preferably as a passenger car, has the internal combustion engine and the exhaust gas tract and can be driven by means of the internal combustion engine. During a fired operation of the internal combustion engine, combustion processes take place in the internal combustion engine, in particular in at least one or several combustion chambers of the internal combustion engine, resulting in the exhaust gas of the internal combustion engine. The exhaust gas can flow out of the respective combustion chamber and into the exhaust gas tract, and consequently flow through the exhaust gas tract, which is also described as an exhaust gas system. At least one component, e.g., an exhaust gas aftertreatment element for aftertreating the exhaust gas, can be arranged in the exhaust gas tract. The exhaust gas aftertreatment element is a catalytic converter, for example, in particular an SCR catalytic converter, wherein for example a selective catalytic reduction (SCR) can be catalytically supported and/or caused by means of the SCR catalytic converter. In the selective catalytic reduction, nitrogen oxides potentially contained in the exhaust gas are at least partially removed from the exhaust gas, as the nitrogen oxides react with ammonia in the selective catalytic reduction to form nitrogen and water. For example, the ammonia is provided by an in particular liquid reduction agent. The exhaust gas aftertreatment element can also be or comprise a particle filter, in particular a diesel particle filter, by means of which particles contained in the exhaust gas, in particular soot particles, can be filtered out of the exhaust gas.

The burner has a combustion chamber in which a mixture that comprises air and a liquid fuel can be ignited and thus combusted. By combusting the mixture, exhaust gas of the burner, in particular of the combustion chamber, is generated, of which the exhaust gas is also described as burner exhaust gas. The burner exhaust gas can for example flow out of the combustion chamber and into the exhaust gas tract, in particular at an introduction point, which is for example arranged upstream of the component in the flow direction of the exhaust gas of the internal combustion engine flowing through the exhaust gas tract. The burner exhaust gas can consequently flow through the component, for example, whereby the component can be heated, i.e., warmed. It is further conceivable that the burner exhaust gas can flow out of the combustion chamber and into the exhaust gas tract, and is thus mixed with the exhaust gas of the internal combustion engine flowing through the exhaust gas tract and/or with a gas flowing through the exhaust gas tract, whereby the exhaust gas of the internal combustion engine or the gas is warmed. In other words, a particularly high temperature, also described as an exhaust gas temperature, of the exhaust gas of the internal combustion engine or of the gas can thus be obtained. The component can be warmed by the high exhaust gas temperature, as the exhaust gas or the gas flows through the component. Thus, for example, the exhaust gas from the combustion chamber is introduced into the exhaust gas tract at the previously specified introduction point, and thus into the exhaust gas or gas flowing through the exhaust gas tract. For example, an ignition device that can in particular be operated electrically is arranged in the combustion chamber, by means of which, for example, at least one ignition spark can be provided, i.e., generated, for igniting the mixture, in particular in the combustion chamber and/or using electrical energy or the current. The ignition device, for example, is a glow plug or a spark plug.

The burner has an inner swirl chamber that can be flowed through by a first part of the air forming the mixture and that causes a turbulent flow of the first part of the air, the inner swirl chamber thus preferably being arranged upstream of the combustion chamber in the flow direction of the first part of the air flowing through the inner swirl chamber. The inner swirl chamber has in particular exactly one first outflow opening that can be flowed through by the first part of the air flowing through the inner swirl chamber and via which the first part of the air flowing through the first outflow opening can be removed from the inner swirl chamber and for example introduced into the combustion chamber. The feature that the inner swirl chamber causes or can cause a turbulent flow of the first part of the air flowing through the inner swirl chamber should in particular be understood to mean that the first part of the air flows through the swirl chamber in a turbulent manner, and thus flows through at least one longitudinal region of the swirl chamber in a turbulent manner and/or the first part of the air only has its turbulent flow at least in a first flow region arranged downstream of the inner swirl chamber and outside of the inner swirl chamber, which first flow region is for example arranged in the combustion chamber. It is in particular conceivable that the first part of the air flows out of the inner swirl chamber via the first outflow opening in a turbulent manner and/or flows into the combustion chamber in a turbulent manner, such that it is particularly preferably provided that the first part of the air has its turbulent flow at least in the combustion chamber.

The burner additionally has an introduction element, in particular an injection element, which has at least or exactly one exit opening that can be flowed through by the liquid fuel. The exit opening is arranged in the inner swirl chamber, such that the introduction element, in particular the injection element, or a conduit of the introduction element that can be flowed through by the liquid fuel leads into the inner swirl chamber via the exit opening. By means of the introduction element, the fuel flowing through the exit opening can be introduced, in particular injected, in particular directly, into the inner swirl chamber via the exit opening, such that the first outflow opening can also be flowed through by the liquid fuel that has exited, in particular been injected out of the injection element via the exit opening and has thus been introduced, in particular injected into the inner swirl chamber, in particular directly. In particular, this means that the first part of the air and the fuel can flow through the first outflow opening along a shared first flow direction and can thus flow out of the inner swirl chamber.

The burner further comprises an outer swirl chamber that surrounds at least one longitudinal region of the inner swirl chamber and preferably also the first outflow opening in the peripheral direction of the inner swirl chamber, in particular completely continuously. For example, the peripheral direction of the inner swirl chamber runs around the previously specified first flow direction, which coincides for example with the axial direction of the inner swirl chamber and thus the first outflow opening. It is preferably provided that the inner swirl chamber ends on the first outflow opening or on the end of the latter in the flow direction of the first part flowing through the first outflow opening and thus in the flow direction of the fuel flowing through the first outflow opening, and thus in the axial direction of the inner swirl chamber and thus the first outflow opening. The outer swirl chamber can be flowed through by a second part of the air, and is designed to cause a turbulent flow of the second part of the air. This should in particular be understood to mean that the second part of the air flows into the outer swirl chamber, and thus flows through at least one part or longitudinal region of the outer swirl chamber in a turbulent manner, and/or the second part of the air has its turbulent flow in a second flow region arranged downstream of the outer swirl chamber in the flow direction of the second part of the air flowing through the outer swirl chamber, the second flow region for example coinciding with the previously specified first flow region, wherein the second flow region can for example be arranged outside of the outer swirl chamber and for example within the combustion chamber. It is further conceivable that the previously specified first flow region is arranged outside of the outer swirl chamber. In other words again, it is conceivable that the second part of the air flows out of the outer swirl chamber in a turbulent manner and/or flows into the combustion chamber in a turbulent manner, such that it is preferably provided that the second part of the air has its turbulent flow at least in the combustion chamber.

The outer swirl chamber has in particular exactly one second outflow opening that can be flowed through by the second part of the air flowing through the outer swirl chamber, by the fuel flowing through the first outflow opening and by the first part of the air flowing through the inner swirl chamber and the first outflow opening, and that is for example arranged downstream of the first outflow opening in the flow direction of the parts and the fuel, the second part of the air being able to be removed from the outer swirl chamber and the parts of the air and the fuel being able to be introduced into the combustion chamber via the second outflow opening. In particular, the parts of the air and the fuel can flow along a second flow direction through the second outflow opening, and thus via the second outflow opening into the combustion chamber, wherein for example the second flow direction runs in parallel with the first flow direction or coincides with the first flow direction. It is further preferably provided that the second flow direction runs in the axial direction of the outer swirl chamber, and thus coincides with the axial direction of the outer swirl chamber, such that it is preferably provided that the axial direction of the inner swirl chamber corresponds to the axial direction of the outer swirl chamber or vice versa. In other words, it is preferably provided that the axial direction of the inner swirl chamber coincides with the axial direction of the outer swirl chamber or vice versa. The respective radial direction of the respective swirl chamber runs perpendicular to the respective axial direction of the respective swirl chamber. For example, as the second outflow opening is arranged downstream of the first outflow opening along the respective flow direction, i.e., in the flow direction of the respective part of the air and in the flow direction of the fuel, and as the outer swirl chamber preferably surrounds the first outflow opening, the first outflow opening is for example arranged in the outer swirl chamber. In particular, it is conceivable that the outer swirl chamber ends on the second outflow opening, in particular on the end of the latter, in particular in the flow direction of the second part of the air flowing through the second outflow opening.

For example, to generate the respective turbulent flow, the respective swirl chamber can have at least one or several swirl generators, by means of which the respective turbulent flow can be or is generated. The respective swirl generator is in particular arranged in the respective swirl chamber. In particular, the swirl generator can for example be a guide vane, by means of which, for example, the respective part, i.e., the respective air forming the respective part, is diverted at least or exactly once, in particular by at least or exactly 70 degrees, in particular by approx. 90 degrees, i.e., for example, by 70 to 90 degrees. The turbulent flow should in particular be understood to mean a flow that extends turbulently or at least substantially helically or as a helix around the respective axial direction of the respective swirl chamber or the respective outflow opening. In particular, the respective axial direction of the respective outflow opening runs perpendicular to a plane in which the respective outflow opening runs. For example, the respective axial direction of the respective outflow opening coincides with the respective axial direction of the respective swirl chamber. The respective outflow opening is for example also described as a respective nozzle, of which the cross-section, which can be flowed through by the respective part of the air, need not, however, necessarily taper along the respective flow direction. Thus, for example, the second outflow opening is also described as an outer nozzle or second nozzle, whereby, for example, the first outflow opening is also described as an inner nozzle or first nozzle.

By causing the respective turbulent flow, the air can particularly advantageously be mixed with the liquid fuel, in particular even only over a small mixing path, in particular in the combustion chamber, such that a particularly advantageous mixture preparation can be obtained, i.e., the mixture can be formed particularly advantageously. In particular, the fuel can first be mixed with the first part of the air particularly well, in particular in the inner swirl chamber, in particular due to the turbulent flow of the first part, in particular in the inner swirl chamber. Additionally, the fuel and also, for example, the first part that has already mixed with the fuel can be particularly advantageously mixed with the second part of the air, in particular in the outer swirl chamber and/or in the combustion chamber, as the second part of the air also has an advantageous turbulent flow. Overall, the parts of the air and the fuel can be mixed particularly advantageously due to the turbulent flows, such that an advantageous mixture preparation can be produced.

So that the component, for example designed as an exhaust gas aftertreatment device or as an exhaust gas aftertreatment system, can be particularly quickly and efficiently heated, in particular even if the exhaust gas of the internal combustion engine only has a low temperature, it can preferably be provided that the first outflow opening (first or inner nozzle) ends in the flow direction of the first part of the air flowing through the first outflow opening, and thus in the flow direction of the fuel flowing through the first outflow opening, on an end edge that has been machined in a targeted manner and is thus sharp or knife-sharp and that is formed by an atomizing lip in particular designed as a solid body, which tapers up to the end edge in the flow direction of the first part of the air flowing through the first outflow opening and thus in the flow direction of the fuel flowing through the first outflow opening and ends on the end edge. This means that the atomizing lip has a taper tapering in the first flow direction and thus in particular towards the combustion chamber that ends, in particular only ends on the end edge. Thus, and in particular due to the targeted machining of the end edge, the taper or the atomizing lip is sharp-edged. In other words, the atomizing lip ends in a sharp edge, whereby a particularly advantageous mixture preparation can be produced.

For example, the mixture is combusted in the combustion chamber while forming a flame, wherein the fuel can in particular be advantageously mixed with the air via the turbulent flow, and wherein the flame of the combustion chamber can advantageously be stabilized in particular due to the turbulent flows. For this purpose, a combustion-induced bursting of vortices can be generated, in particular via the turbulent flows. For this purpose, for example, the air flowing into the combustion chamber in the respective swirl chamber is first deflected by approximately 70 degrees or by approximately 90 degrees, in particular in a range from 70 degrees to 90 degrees, which can for example be realized via the respective swirl generator. For example, the inner swirl chamber and the outer swirl chamber form a swirl chamber also described as a total swirl chamber, which is sub-divided in the invention into the inner swirl chamber and the outer swirl chamber. The inner swirl chamber and the outer swirl chamber are preferably separated by a dividing wall in particular designed as a solid body, in particular in the radial direction of the respective swirl chamber. It is conceivable that the dividing wall surrounds at least the specified longitudinal region of the inner swirl chamber in the peripheral direction of the inner swirl chamber running around the axial direction of the inner swirl chamber, in particular completely continuously, such that for example at least the longitudinal region of the inner swirl chamber is formed or delimited outwards in the radial direction of the inner swirl chamber, in particular directly, by the dividing wall. It is further conceivable that at least a second longitudinal region of the outer swirl chamber is formed or delimited inwards in the radial direction of the outer swirl chamber, in particular directly, by the dividing wall. It is in particular conceivable that the longitudinal regions of the swirl chambers are arranged at the same height in the axial direction of the respective swirl chamber. During an operation of the burner, only air, i.e., only the second part of the air, flows through the outer swirl chamber, while or wherein air, i.e., the first part, and the liquid fuel flow through the inner swirl chamber. The fuel can thus already be advantageously mixed with the first part of the air in the inner swirl chamber. The introduction element, in particular the injection element, can be an injection nozzle, of which the outflow opening is for example arranged in or on an end face or end surface of the injection element, of which the end face or end surface runs in an end face or end surface plane running perpendicular to the axial direction of the respective swirl chamber. It is further conceivable that the introduction element is designed as a lance, which has a longitudinal extension that coincides for example with the respective axial direction of the respective swirl chamber or the respective outflow opening. For example, the lance has at least or exactly, in particular at least or exactly two exit openings, which can be designed as holes, in particular as transverse holes. The exit opening has a through direction along which the fuel can flow through the exit opening. In particular, if the introduction element is designed as an injection nozzle, the through direction of the exit opening runs in parallel with the respective axial direction of the respective swirl chamber or the through direction coincides with the respective axial direction of the respective swirl chamber or the respective outflow opening. In particular, if the introduction element is designed as a lance, the through direction runs obliquely or preferably perpendicular to the axial direction of the respective swirl chamber or the respective outflow opening.

It is in particular conceivable that at least the inner swirl chamber is formed by a component in particular designed as a solid body, which also forms the atomizing lip and thus the end edge. In particular, a lateral surface of the component on the internal periphery delimits the inner swirl chamber outwards in the radial direction of the inner swirl chamber. The component, in particular its lateral surface on the internal periphery, is or functions for example as a prefilmer between the swirl chambers, and thus between the turbulent and thus swirled flows, also described as air flows. It is in particular conceivable that the lateral surface on the internal periphery or the prefilmer is formed by the previously specified dividing wall or that the component forms or has the previously specified dividing wall. By means of the introduction element, the fuel flowing through the exit opening and that has thus exited, in particular been injected, out of the introduction element is applied to the prefilmer, in particular to the lateral surface on the internal periphery, in particular as a film also described as a fuel film or is atomized on the prefilmer between the two swirled air flows. Due to centrifugal forces resulting from the turbulent flow of the first part of the air, the fuel that has exited, in particular been injected, out of the introduction element, and has thus been introduced, in particular injected, i.e., sprayed, in particular directly into the inner swirl chamber, in particular as the previously specified film, is applied to the prefilmer, in particular to the lateral surface on the internal periphery, and flows or streams downstream to the first outflow opening, also described as a nozzle opening, and thus to the end edge. The fuel is thus applied to the atomizing lip and fed or transported to the end edge. For example, the first outflow opening ends on the knife-sharp end edge, which has or provides only a small surface area due to the previously described tapering, such that no excessively large droplets of the fuel can form on the end edge. Due to the configuration of the atomizing lip and in particular of the end edge, only tiny little droplets of the fuel break away on the end edge. In other words, only particularly small, i.e., tiny, droplets arise from the previously specified fuel film at the end edge, which break away on the end edge, in particular from the atomizing lip or from the component, and have a correspondingly large surface area. This effect leads to a particularly low-soot combustion of the mixture in the combustion chamber. Tiny droplets of the fuel can thus be generated even without high injection pressures of the fuel generated with significant effort and without high-cost injection elements, such that, on the one hand, the costs of the burner can be kept particularly low. On the other hand, particularly small droplets of the fuel can be generated, such that very low output of the burner can also be represented. The invention is in particular based on the knowledge that conventional burners have an excessively high pressure loss and are unsuitable for low outputs, and thus disadvantageous with regard to fuel consumption. The previously specified problems and disadvantages can now be avoided via the invention, such that in particular the fuel consumption can be kept low. Where the injection element is mentioned in the following, this should be understood to mean the introduction element.

Where the gas flowing through the exhaust gas tract is mentioned in the following, this should be understood to mean the previously specified exhaust gas of the internal combustion engine or the previously specified gas, if nothing else is specified. It is conceivable that the previously specified introduction point at which the burner exhaust gas is introduced into the exhaust gas tract or into the gas is arranged downstream or upstream of an oxidation catalyst, for example designed as a diesel oxidation catalyst, of the exhaust gas tract in the flow direction of the gas flowing through the exhaust gas tract. The oxidation catalyst is in particular designed to oxidize unburned hydrocarbons (HC) potentially contained in the exhaust gas and/or to oxidize carbon monoxides (CO) potentially contained in the exhaust gas, in particular into carbon dioxide.

So that the burner can be particularly advantageously operated and the component can be heated up and/or kept warm particularly quickly and efficiently, it is provided in the first aspect of the invention that, to start the initially deactivated burner, the fuel is introduced, in particular injected, in particular directly into the inner swirl chamber by means of the introduction element, in particular the injection element over a first period of time that can be or is in particular pre-determined. The feature that, for example, the first period of time can be or is pre-determined should be understood to mean that a duration of the first period of time can be or is pre-determined. Starting the burner and the feature that the burner is initially deactivated should in particular be understood to mean that during a second period of time preceding the first period of time, in particular immediately or directly, the burner is deactivated, in particular continuously, such that during the second period of time, introduction, in particular injection, of the fuel into the inner swirl chamber and active supply of the swirl chambers with air and ignition in the combustion chamber cease, i.e., do not take place, in particular continuously. The feature that the second period of time precedes the first period of time immediately or directly should in particular be understood to mean that no other, further period of time lies between the first period of time and the second period of time, such that the second period of time preferably ends when the first period of time begins or, vice versa, such that the first period of time begins with the end of the second period of time. In particular, the first period of time begins with the fuel being introduced, in particular injected, into the inner swirl chamber by means of the introduction element. It is in particular provided that during the first period of time, the fuel is introduced, in particular injected, continuously, i.e., without interruption, into the inner swirl chamber by means of the introduction element. It is further provided according to the invention that during the first period of time, active supply of the swirl chamber with air ignition in the combustion chamber continuously cease. Actively supplying the swirl chambers should be understood to mean that the air is actively (i.e., by active operation of the air pump) fed by means of a feeding device also described or designed as an air pump into the swirl chambers, and thus into the burner, and thus the swirl chambers are supplied with the air and thus with the parts of the air, wherein during the first period of time, and preferably also during the second period of time, such an active supply of the swirl chambers with the air, and thus with the parts, ceases. The feature that an or the ignition in the combustion chamber ceases during the first period of time and preferably also during the second period of time should in particular be understood to mean that no active ignition processes, by means of which the mixture could be ignited in the combustion chamber if the mixture were present in the combustion chamber, are implemented or take place in the combustion chamber, such that in particular during the first period of time, and also preferably during the second period of time, for example, no ignition spark or other ignition event is carried out in the combustion chamber.

It is further provided according to the invention that after the first period of time, i.e., after the first period of time has passed, the swirl chambers are actively supplied with the air in particular by means of the feeding device, the fuel is introduced, in particular injected, into the inner swirl chamber by means of the introduction element, and thus the mixture is generated in the combustion chamber and is ignited, in particular by means of a or the ignition device, in particular actively, for example such that the ignition device generates or provides at least one ignition spark, in particular of a combustion chamber. In other words, a third period of time follows the first period of time, in particular immediately or directly, the third period of time preferably lasting at least 10 seconds. It is thus preferably provided that the first period of time ends when the third period of time begins or vice versa, that the third period of time begins when the first period of time ends. In particular, the third period of time begins when the swirl chambers are actively supplied with the air, in particular upon activation of the for example initially deactivated feeding device, which is for example deactivated during the first period of time and during the second period of time, in particular continuously, i.e., is out of operation. Further, for example, the third period of time begins when the ignition device that is initially deactivated and for example designed as a glow plug, glow element or spark plug is activated. For example, the ignition device is deactivated, in particular continuously, during the first period of time and during the second period of time.

During the third period of time, the swirl chambers are actively supplied with the air, in particular as the air is actively fed to and into the swirl chambers by means of the feeding device. For example, the feeding device is or can be operated electrically. In addition, during the third period of time, the fuel is introduced, in particular injected into the inner swirl chamber by means of the introduction element. It is conceivable that the fuel is introduced into the inner partial chamber continuously, i.e., without interruption, during the third period of time by means of the introduction element, or during or within the third period of time, several introductions, i.e., injections, that follow one another chronologically and are spaced apart from one another are carried out by means of the introduction element, in which the fuel is respectively introduced, in particular directly, into the inner swirl chamber by means of the introduction element. Due to the active supply of the swirl chamber with the air, the air and thus the parts flow through the swirl chambers, and due to the active supply of the swirl chamber with the air and due to the introduction, in particular injection, of the fuel into the inner swirl chamber, the mixture is formed that is ignited and combusted during or within the third period of time. This means in particular that during the third period of time, an or the ignition of the mixture in the combustion chamber is implemented, such that the mixture is combusted in the combustion chamber within or during the third period of time, in particular without interruption. It is thus provided that during the first period of time and during the second period of time, the burner does not provide a flame or burner exhaust gas. During the third period of time, however, the burner provides the burner exhaust gas resulting from the ignition and combustion of the mixture or a flame resulting from the ignition and combustion of the mixture, in particular continuously or without interruption, whereby the component can be heated and/or kept warm. As the fuel is introduced into the inner swirl chamber during the first period of time, but an active supply of the swirl chamber with air and an ignition in the combustion chamber cease, a so-called pre-storage of the fuel in the inner swirl chamber is obtained or carried out. The invention is based in particular on the following knowledge and considerations: During a start designed in particular as a cold start of the initially deactivated burner, there is still no high temperature and no high air movement in the respective swirl chamber. This state does not permit the mixture to be ignited in the combustion chamber, or at least makes such an ignition more difficult. The method according to the invention now enables the initially deactivated burner to be started quickly and effectively, and in particular also when the internal combustion engine is running and/or in cold environmental conditions. For this purpose, an ignitable mixture in the combustion chamber is advantageous, which can be obtained by the pre-storage according to the invention of the fuel.

It has proved particularly advantageous if the first period of time lasts for at least 0.3 seconds. An ignitable mixture can thus be realized in the combustion chamber, such that the burner can be started quickly and effectively.

To start the burner quickly, effectively and efficiently, i.e., in a manner that uses little fuel, it is provided in a further embodiment of the invention that the first period of time lasts for 6 seconds at most, in particular 4 seconds at most. In other words, it is preferably provided that the first period of time lasts 0.3 to 6 seconds, in particular 0.3 to 4 seconds, in particular continuously or without interruption.

Due to the pre-storage according to the invention of the fuel, a particularly rich mixture is formed, in particular of the combustion chamber, whereby the particularly rich mixture offers a large fuel surface area suitable for ignition despite large droplets and despite high dimensions.

To implement a particularly efficient operation of the burner, it is provided in a further embodiment of the invention that at least after the period of time, i.e., for example during the third period of time, a first quantity of the air and a second quantity of the fuel are determined by means of an electronic computer also described as a control device. In other words, a first quantity of the air is determined after the period of time by means of the electronic computer, the quantity being actively added to the swirl chambers within or during the third period of time or after the first period of time. In other words again, after the first period of time, i.e., for example during the third period of time, the electronic computer determines the first quantity of air with which the swirl chambers are provided, in particular actively, i.e., for example by operating the air pump. In addition, after the first period of time, i.e., for example during the third period of time, the electronic computer determines a second quantity of the fuel that is introduced into the inner swirl chamber by means of the introduction element after the first period of time, i.e., during and within the third period of time. The first quantity is also described as an air quantity or air mass, and the second quantity is also described as a fuel quantity or fuel mass. For example, the air quantity, is calculated and thus determined, in particular by means of the electronic computer. It is further conceivable that the air quantity is measured, in particular by means of a first sensor. For example, the first sensor provides at least one in particular electrical first signal that characterises the air quantity measured by means of the first sensor. The electronic computer can receive the first signal and thus determine the in particular measured air quantity. It is further conceivable that the fuel quantity is calculated and thus determined, for example by means of the electronic computer. It is further conceivable, for example, that the fuel quantity is measured by means of a second sensor. For example, the second sensor provides an in particular electrical second signal that characterizes the fuel quantity measured by means of the second sensor. The electronic computer can for example receive the second signal and thus determine the in particular measured fuel quantity. It is further preferably provided that after the first period of time, i.e., for example during the third period of time, at least one actual value of a fuel-air ratio of the mixture, also described as lambda (Greek lower-case letter lambda), is determined, in particular calculated, by means of the electronic computer depending on the first quantity and depending on the second quantity. It is further preferably provided that the burner is operated depending on the determined actual value by means of the electronic computer after the first period of time, and thus during the third period of time. A lambda regulation and a lambda regulated operation of the burner are thus preferably provided, whereby a particularly effective and efficient operation of the burner can be guaranteed.

It has proved particularly advantageous if the electronic computer controls the introduction element depending on the determined actual value, in particular electrically, in particular after the first period of time, and thus within or during the third period of time, and thus operates the burner depending on the determined actual value. By controlling the introduction element, the fuel quantity can for example be adjusted, in particular controlled, by means of the electronic computer via the introduction element, whereby a particularly effective and efficient operation of the burner can be achieved.

A further embodiment is characterized in that the previously described air pump is provided, by means of which the air is to be actively fed to the swirl chambers, and thus actively to and into the burner, or is in particular fed during the third period of time. As an alternative or in addition, a fuel pump is provided, by means of which the fuel is to be actively fed to and through the introduction element and thus via the introduction element into the inner swirl chambers. It can in particular be provided that the fuel pump is or can be operated electrically. In other words, the fuel pump is operated actively during the third period of time, whereby the liquid fuel is actively fed to and in particular through the introduction element by means of the fuel pump, whereby the fuel is introduced into the inner swirl chamber via the introduction element. The fuel pump is for example operated electrically during the third period of time. With regard to the first period of time and the second period of time, it is thus preferably provided that during the second period of time, the air pump and the fuel pump are deactivated, and are thus out of operation, such that during the second period of time, no air is fed to the swirl chambers by means of the air pump. Additionally, no fuel is fed to and through the introduction element by means of the fuel pump during the second period of time. For example, to pre-store the fuel during the first period of time, and thus to introduce the fuel into the inner swirl chamber by means of the introduction element, the fuel pump is operated during or within the first period of time, in particular actively, such that, for example, the first period of time begins when the initially deactivated fuel pump is activated, in particular while the air pump remains deactivated. It is further conceivable that during the third period of time, both the fuel pump and the air pump are activated and thus are operated, in particular electrically, such that for example the third period of time begins when the initially deactivated air pump is activated, i.e., is set into operation.

To implement a particularly precise lambda control of the burner, it is provided in a further embodiment of the invention that a piston pump, in particular a frequency-controlled piston pump is used as the fuel pump. By means of such an in particular frequency-controlled piston pump, the fuel can be fed or dosed particularly exactly, such that the fuel quantity, and thus also the fuel-air ratio, can be determined, in particular calculated particularly precisely.

For example, the piston pump has a pump housing that can be flowed through by the fuel and a piston also described as a feeding piston which is at least partially, in particular at least substantially or completely received in the pump housing. The piston can be moved along a piston direction relative to the pump housing, in particular translationally, to thus feed the fuel. The piston pump, in particular the pump housing, has an exit, via which the fuel flowing through the pump housing and fed by means of the piston can be removed from the pump housing, and is or can thus be fed away from the fuel pump and for example to the introduction element. It is preferably provided that a spring-loaded valve is arranged on the exit, the valve for example being designed or functioning as a check valve. The valve thus comprises a valve body and an in particular mechanical spring, for example. In particular if the valve body is designed as a ball, the valve is designed as a ball valve. The valve body can for example be moved relative to the pump housing, in particular translationally, between at least one closed position and at least one open position. In the closed position, the exit is fully blocked by the valve body, and the valve body releases it in the open position. It is preferably provided that the valve body or the valve opens in the direction of the introduction element, and thus releases the exit, and blocks the exit in the opposite direction, and thus for example in the direction of the piston or in the direction of an interior of the pump housing, and thus closes the exit. The fuel can thus be fed through the exit and thus out of the pump housing and into the introduction element by means of the piston, a flow in the opposite direction of fuel or another fluid, e.g., an exhaust gas, out of the combustion chamber can however be avoided by means of the valve body or by means of the valve, as the valve or the valve body blocks the exit for a flow of a fluid, e.g., an exhaust gas—coming from the introduction element and pointing into the pump housing—out of the combustion chamber. By means of the valve, a backward flow of fuel or exhaust gas can thus be avoided.

To implement a particularly effective and efficient operation of the burner, it is provided in a further embodiment of the invention that the electronic computer controls the air pump and/or the fuel pump depending on the determined actual value, in particular electrically, and thus operates the air pump and/or the fuel pump depending on the determined actual value, whereby the electronic computer operates the burner depending on the determined actual value. The fuel-air ratio can thus be adjusted particularly precisely and quickly, in particular to a desired target value, wherein the target value preferably lies in a range of 0.95 to 1.05 inclusive and is preferably 1.03.

A further embodiment is characterized in that by means of the electronic computer, the actual value is compared with the target value that can be or is in particular pre-determined, and the burner is operated depending on the comparison of the actual value with the target value. It is in particular conceivable that the electronic computer controls and thus operates the introduction element and/or the fuel pump and/or the air pump depending on the comparison, and in particular depending on a difference between the target value and the actual value, in particular electrically, whereby the burner is operated, in particular controlled, depending on the comparison. A particularly precise lambda regulation can thus be obtained.

To implement a particularly advantageous, and in particular efficient and effective operation of the burner, it is provided in a second aspect of the invention that a first quantity of air also described as an air quantity and a second quantity of fuel also described as a fuel quantity are determined by means of an electronic computer also described as a control device. Depending on the first quantity and the second quantity, at least one actual value of a fuel-air ratio of the mixture is determined, in particular calculated, by means of the electronic computer. In addition, the burner is operated independently of the determined actual value by means of the electronic computer. A particularly advantageous lambda regulation of the burner can thus be implemented, such that a particularly efficient and effective, in particular low-fuel, efficient and effective, in particular low-fuel and low-emission operation of the burner can be implemented. Advantages and advantageous embodiments of the first aspect of the invention should be seen as advantages and advantageous embodiments of the second aspect of the invention and vice versa.

Further advantages, features and details of the invention result from the following description of preferred exemplary embodiments and with reference to the drawings. The features and combinations of features specified previously in the description and the features and combinations of features specified in the following description of figures and/or shown in the figures alone can be used not only in the respectively specified combination, but also in other combinations or in isolation without leaving the scope of the invention.

DETAILED DESCRIPTION OF THE DRAWINGS

Figure 1:
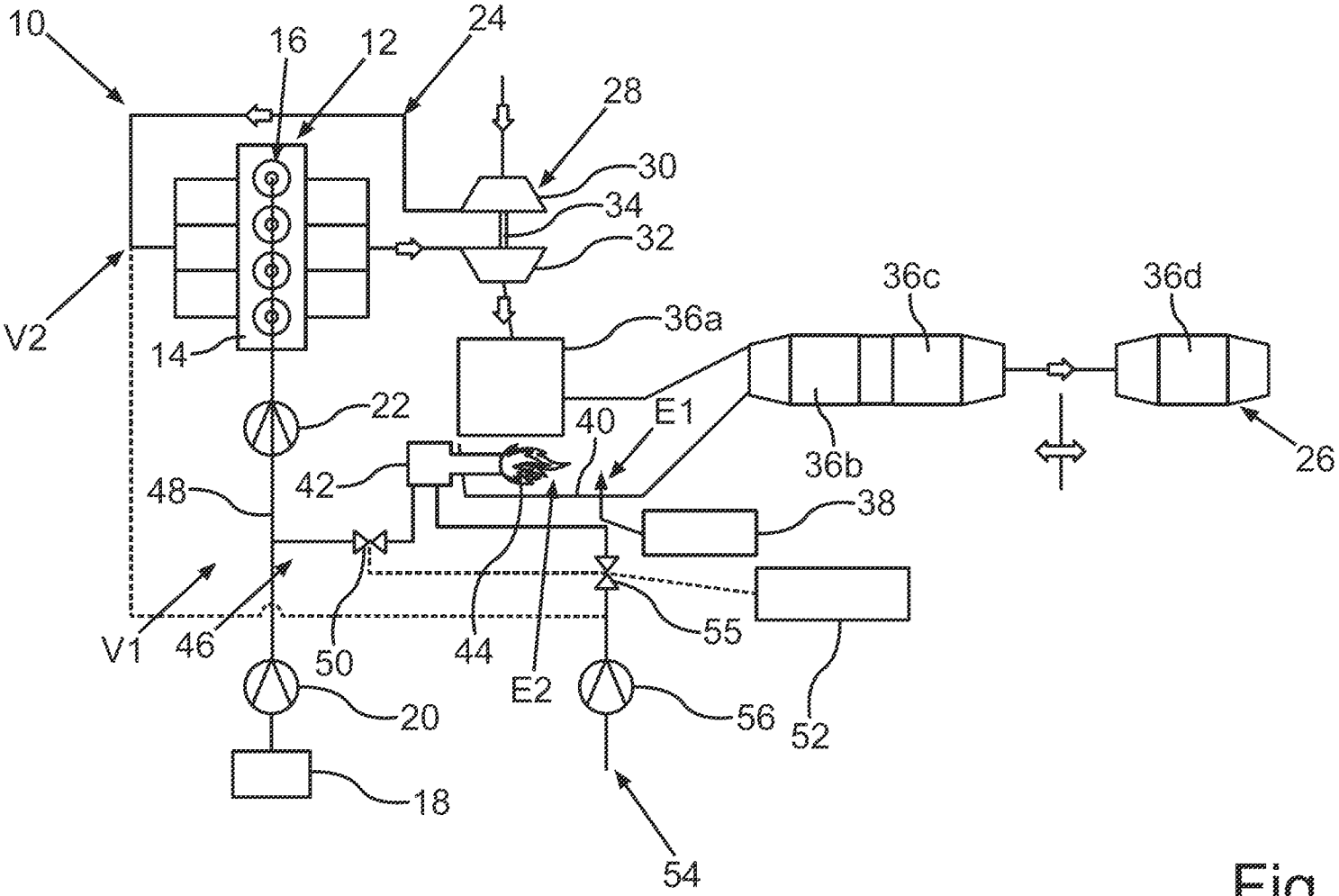
FIG. 1 shows a schematic depiction of a drive device of a motor vehicle having an internal combustion engine, an exhaust gas tract and a burner according to the invention.

Identical or functionally identical elements are provided with the same reference numerals in the figures.

FIG. 1 shows, in a schematic depiction, a drive device 10 of a motor vehicle preferably designed as a motor car, in particular as a passenger car. This means that the motor vehicle designed as a land vehicle has the drive device 10 in its fully produced state and can be driven by means of the drive device 10. The drive device 10 has an internal combustion engine 12 also described as an internal combustion motor, which has a motor engine 14 also described as an engine housing. The internal combustion engine 12 additionally has cylinders 16, which are formed or delimited, in particular directly, by the engine block 14. During a fired operation of the internal combustion engine 12, respective combustion processes are running in the cylinders 16, from which an exhaust gas of the internal combustion engine 12 results. For this purpose, an in particular liquid fuel is introduced, in particular directly injected, into the respective cylinder 16 within a respective work cycle of the internal combustion engine 12. The internal combustion engine 12 can be designed as a diesel engine, such that the fuel is preferably a diesel fuel. A tank 18, also described as a fuel tank, is provided in which the fuel is or can be received. A respective injector is for example assigned to the respective cylinder 16, by means of which the fuel can be introduced, in particular directly injected, into the respective cylinder 16. By means of a low-pressure pump 20, the fuel is fed from the tank 18 to a high-pressure pump 22, by means of which the fuel is fed to the injectors or to a fuel distribution element shared by the injectors and also described as a rail or a common rail. The injectors can be provided with the fuel from the fuel distribution element shared by the injectors by means of the fuel distribution element, and can introduce, in particular directly inject, the fuel from the fuel distribution element into the respective cylinder 16.

The drive device 10 comprises an intake tract 24 that can be flowed through by fresh air, by means of which the fresh air flowing through the intake tract 24 is guided to and into the cylinder 16. The fresh air forms a mixture of fuel and air with the fuel, which mixture comprises the fresh air and the fuel, and is ignited and thus combusted in the respective cylinder 16 within the respective work cycle. The mixture of fuel and air is in particular ignited via self-ignition. Exhaust gas of the internal combustion engine 12, of which the exhaust gas is also described as engine exhaust gas, results from the ignition and combustion of the mixture of fuel and air.

The drive device 10 has an exhaust gas tract 26 that can be flowed through by the exhaust gas from the cylinders 16. The drive device 10 additionally comprises an exhaust gas turbocharger 28 that has a compressor 30 arranged in the intake tract 24 and a turbine 32 arranged in the exhaust gas tract 26. The exhaust gas can flow out of the cylinders 16, flow into the exhaust gas tract 26 and then flow through the exhaust gas tract 26. The turbine 32 can be driven by the exhaust gas flowing through the exhaust gas tract 26. The compressor 30 can be driven by the turbine 32, in particular via a shaft 34 of the exhaust gas turbocharger 28. By driving the compressor 30, the fresh air flowing through the intake tract 24 is compressed by means of the compressor 30. Several components 36*a-d* are arranged in the exhaust gas tract 26, the components being designed as respective exhaust gas aftertreatment devices, i.e., exhaust gas aftertreatment components for aftertreating the exhaust gas. The components 36*a-d* are arranged following one after the other in the flow direction of the exhaust gas of the internal combustion engine 12 flowing through the exhaust gas tract 26, and are thus connected to one another in series or serially. For example, the component 36*a* is an oxidation catalyst, in particular a diesel oxidation catalyst (DOC). Furthermore, the component 36 can be a nitrogen oxide storage catalyst (NSK). The component 36*b* can be an SCR catalyst, which is also simply described as an SCR. The component 36*c* can be a particle filter, in particular a diesel particle filter (DPF). The component 36*d* can for example have a second SCR catalyst and/or an ammonia slip catalyst (ASC)

The motor vehicle has a structure for example designed as a self-supporting body that forms or delimits an interior of the motor vehicle also described as a passenger cell or safety cell. During a respective journey of the motor vehicle, people can be located in the interior. For example, the structure forms or delimits an engine compartment in which the internal combustion engine 12 is arranged. The exhaust gas turbocharger 28 is for example arranged in the engine compartment. The structure additionally has a base, also described as a main base, via which the interior is at least partially, in particular at least substantially or completely delimited downwards in the vertical direction of the vehicle. For example, the components 36*a, b, c* are arranged in the engine compartment, such that for example the components 36*a, b* and *c* form a so-called hot end or are components of a so-called hot end. The hot end can in particular be directly flange-mounted on the turbine 32. The component 36*d* is for example arranged outside of the engine compartment and underneath the base in the vertical direction of the vehicle, such that for example the component 36*d* forms a so-called cold end or is a component of the so-called cold end.

The drive device 10 comprises a dosing device 38, by means of which an in particular liquid reducing agent can be introduced into the exhaust gas tract 26 at an introduction point E1 and can for example be introduced into the exhaust gas flowing through the exhaust gas tract 26. The reducing agent is preferably an aqueous urea solution that can provide ammonia, which can react with nitrogen oxides potentially contained in the exhaust gas to form water and nitrogen in a selective catalytic reduction. The selective catalytic reduction can be catalytically caused and/or supported by the SCR catalyst. It can be seen from FIG. 1 that the introduction point E1 is arranged upstream of the component 36*b* and downstream of the component 36*a* in the flow direction of the exhaust gas flowing through the exhaust gas tract 26. The exhaust gas tract 26 preferably has a mixing chamber 40 in which the reducing agent introduced into the exhaust gas at the introduction point E can be advantageously mixed with the exhaust gas.

The drive device 10 and thus the motor vehicle additionally comprise a burner 42 by means of which—as is explained in more detail in the following—at least one of the components 36*b, c, d* arranged downstream of the burner 42 in the flow direction of the exhaust gas flowing through the exhaust gas tract 26 can be quickly and efficiently heated and/or kept warm. The burner 42 can combust a mixture, in particular while forming a flame 44, and in particular while providing a burner exhaust gas, wherein the burner exhaust gas or the flame 44 is or can be introduced into the exhaust gas tract 26 at an introduction point E2. This means that the burner 42 is arranged so to speak on the introduction point E2. In the exemplary embodiment described in FIG. 1, the introduction point E2 is arranged upstream of the components 36*b, c* and *d* and downstream of the component 36*a*. In other words, in the exemplary embodiment shown in FIG. 1, the burner 42 is arranged upstream of the components 36*b, c, d* and downstream of the component 36*a*. As an alternative, it is conceivable that the burner 42 or the introduction point E2 is arranged upstream of the component 36*a* and in particular downstream of the turbine 32. The previously specified mixture to be combusted in the burner 42 or by means of the burner 42 comprises air and a liquid fuel. In the exemplary embodiment shown in FIG. 1, the propellant used as the combustible fuel and/or at least a partial quantity of the air which is added to the burner 42 and is used to form the mixture, can for example originate from the intake tract 24. For this purpose, a fuel supply path 46 is provided, which is or can be fluidically connected to the burner 42 on the one hand and on the other hand to a fuel conduit 48. The fuel conduit 48 can be flowed through by the fuel flowing from the tank 18 to the injectors or to the fuel distribution element. The fuel supply path 46 is fluidically connected to the fuel conduit 48 at a first connection point V2, wherein the connection point V2 is arranged downstream of the low-pressure pump 20 and upstream of the high-pressure pump 22 in the flow direction of the fuel flowing from the tank 18 to the fuel distribution element or to the respective injector. At least a part of the liquid fuel flowing through the fuel conduit 48 can be removed from the fuel conduit 48 at the connection point V2 and introduced into the fuel supply path 46. The fuel introduced into the fuel supply path 46 can flow through the fuel supply path 46 and is guided to and in particular into the burner 42 as the fuel by means of the fuel supply path 46. A first valve element 50 is arranged in the fuel supply path 46, by means of which a quantity of the fuel flowing through the fuel supply path 46 and thus to be added to the burner 42 can be adjusted. An electronic computer 52 also described as a control device is provided, by means of which the valve element 50 can be controlled, such that the quantity of the fuel flowing through the fuel supply path 46 and to be added to the burner 42 can be adjusted, in particular is to be regulated, by means of the control device via the valve element 50.

An air supply path 54 is further provided, via which or by means of which the burner can be or is provided with the air to form the mixture. This means that the air supply path 54 can be flowed through by the air from which the mixture is formed. A pump 56 also described as an air pump is arranged in the air supply path 54, by means of which pump the air can be fed through the air supply path 54 and can thus be fed to the burner 42. For example, the low-pressure pump 20 also described as a low-pressure fuel pump is described as a fuel pump, by means of which the fuel is fed through the fuel supply path 46 and thus to the burner 42.

It can be recognized that the air supply path 54 is fluidically connected to the intake tract 24 at a second connection point V2. Thus, for example, at least a part of the fresh air flowing through the intake tract 24 can be removed from the intake tract 24 at the connection point V2 and introduced into the air supply path 54. The fresh air introduced into the air supply path 54 can flow through the air supply path 54 as the air, and is guided to and in particular into the burner 42 by means of the air supply path 54. A second valve element 55 is arranged in the air supply path 54, by means of which second valve element the quantity of the air that is used to form the mixture and flows through the supply path 54 and thus flows through the burner 42 can be adjusted. For example, the control device is designed to control the valve element 55, such that for example the quantity of the air that is used to form the mixture and flows through the air supply path 54 and thus to be added to the burner 42 can be adjusted, in particular is to be controlled, by means of the control device via the valve element 55.

Figure 2:
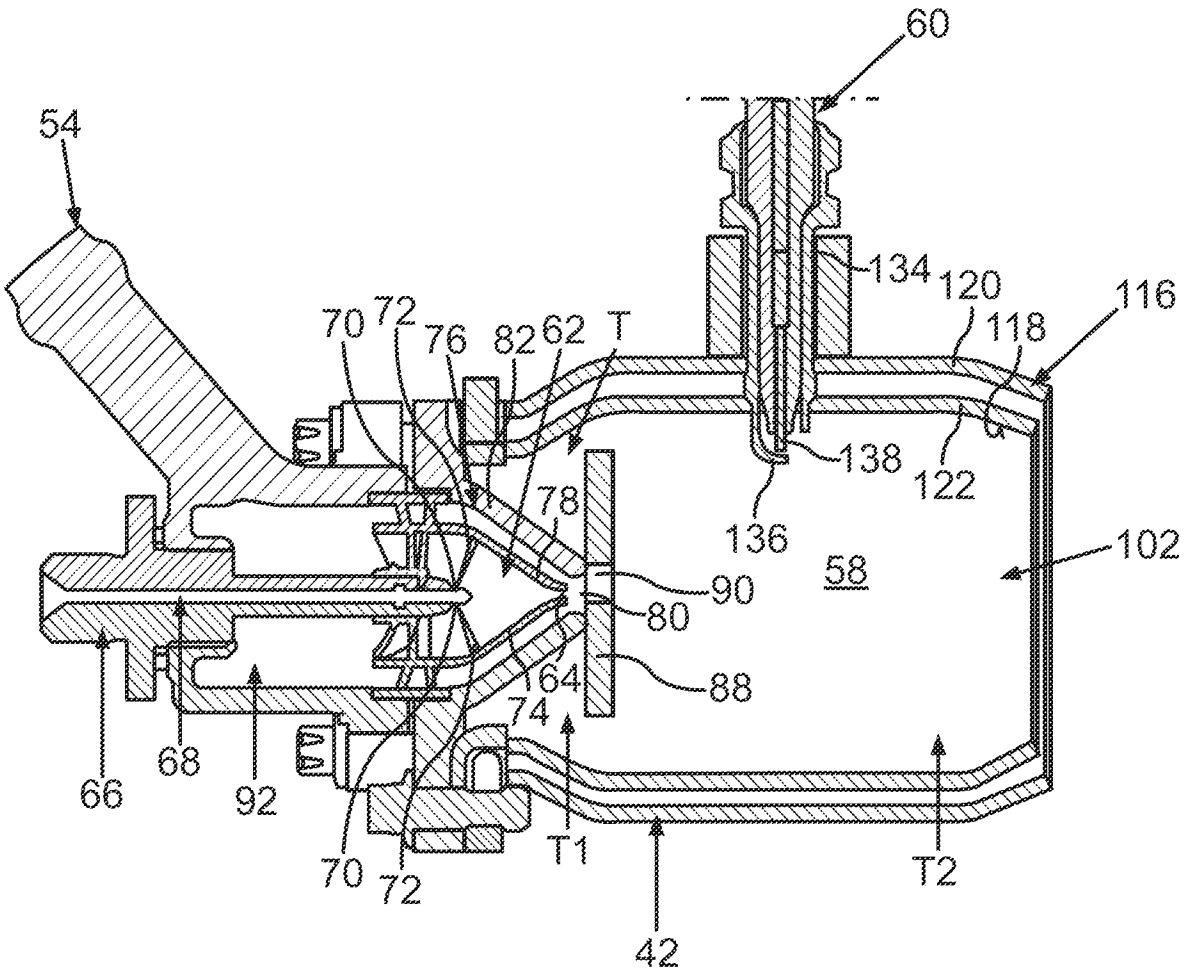
FIG. 2 shows a schematic longitudinal sectional view of a first embodiment of the burner.

FIG. 2 shows a first embodiment of the burner 42 in a schematic sectional view. The burner 42 has a combustion chamber 58 in which the air added to the burner 42 and the mixture added to the burner 42 and comprising liquid fuel is to be ignited and thus combusted, i.e., it to be ignited and thus combusted during an operation of the burner 42. For this purpose, an ignition device 60 designed for example as a spark plug or glow plug or glow element is provided, by means of which ignition device at least one ignition spark can be generated in the combustion chamber 58, in particular using electrical energy or electrical current. By means of the ignition spark, the mixture in the combustion chamber 58 is ignited and combusted, in particular while providing the burner exhaust gas and/or while providing the flame 44. By means of the burner exhaust gas or by means of the flame 44, the exhaust gas flowing through the exhaust gas tract 26 can for example be quickly and efficiently heated and/or kept warm, such that, for example, at least the component 36*b* can be quickly and efficiently heated and/or kept warm by means of the exhaust gas that has been heated and/or kept warm and that flows through the components 36*b, c* and *d*.

The burner 42 has an inner swirl chamber 62 that can be flowed through by a first part of the air that is added to the burner 42, and causes a turbulent first flow of the first part of the air. This should in particular be understood to mean that the first part of the air flows turbulently through at least one first partial region of the swirl chamber 62 and/or flows turbulently out of the swirl chamber 62 and/or flows turbulently into the combustion chamber 58. The inner swirl chamber 62 has in particular exactly one first outflow opening 64 that can be flowed through by the first part of the air along a first through direction of the outflow opening 64 and thus along a first flow direction coinciding with the first through direction. The first part of the air can be removed from the inner swirl chamber 62 via the first outflow opening 64. This means that the first part of the air can flow out of the inner swirl chamber 62 via the first outflow opening 64. The burner 42 further comprises an introduction element in the form of an injection element 66, which has a conduit 68 that can be flowed through by the liquid fuel that is added to the burner 42.

In the first embodiment, the injection element 66 is designed as a lance that is also described as a fuel lance. The conduit 68, and thus the injection element 66, has at least one exit opening 70 that can be flowed through by the liquid fuel flowing through the conduit 68. It can be seen from FIG. 2 that in the first embodiment, the conduit 68, and thus the injection element 66 has at least or exactly two exit openings 70, for example designed as holes. The exit opening 70 can be flowed through by the fuel along a respective second through direction, such that the fuel flowing through the injection element 66 can be injected out of or can exit from the injection element 66 via the respective exit opening 70 and can be injected, and thus introduced, into the inner swirl chamber 62, in particular directly. In other words, the injection element 66 or the conduit 68 leads into the inner swirl chamber 62 via the respective exit opening 70, such that the liquid fuel can be injected into the inner swirl chamber 62, in particular directly, via the respective exit opening 70 by means of the injection element 66. The respective second through direction of the respective exit opening 70 coincides with a respective second flow direction along which the fuel can flow through the respective exit opening 70. It can be recognized that the fuel can be injected out of the injection element 66 via the respective exit opening 70 while forming a respective fuel jet 72, and can thus be injected, in particular directly, into the inner swirl chamber 62. For example, the respective fuel jet 72, of which the longitudinal central axis coincides for example with the respective second through direction or with the respective second flow direction, is designed at least substantially conically. In addition, for example, the injection element 66, and thus presently the conduit 68, has a longitudinal direction or longitudinal extension or longitudinal extension direction that runs in parallel with the first through direction, and thus in parallel with the first flow direction, in particular with the first through direction, and thus coincides with the first flow direction. It can further be seen from FIG. 2 that the first through direction, and thus the first flow direction coincide with the axial direction of the outflow opening 64 and with the axial direction of the inner swirl chamber 62. The respective second through direction or the respective second flow direction runs perpendicularly or presently obliquely to the first through direction, and thus to the first flow direction and to the axial direction of the swirl chamber 62 and the outflow opening 64.

The swirl chamber 62 is at least partially, in particular at least substantially and thus more than half or even completely formed or delimited by a preferably single-part component 74 preferably of the burner 42, such that the component 74 also forms or delimits the outflow opening 64.

The burner 42 further has an outer swirl chamber 76 that surrounds at least one longitudinal region and presently also the first outflow opening 64 in the peripheral direction of the swirl chamber 62, in particular completely continuously running around the axial direction of the swirl chamber 62. The component 74 has a dividing wall 78 that is arranged between the swirl chambers 62 and 76 in the radial direction of the swirl chamber 62 and the radial direction of which runs perpendicular to the axial direction of the swirl chamber 62. The swirl chambers 62 and 76 are thus separated from each other in the radial direction of the swirl chamber 65 by the dividing wall 78. The axial direction of the swirl chamber 62 coincides with the axial direction of the swirl chamber 76, such that the radial direction of the swirl chamber 62 coincides with the radial direction of the swirl chamber 76. The outer swirl chamber 76 can be flowed through by a second part of the air, which is added to the burner 42, and is designed to cause a turbulent second flow of the second part of the air. This means that the second part of the air flows turbulently through the swirl chamber 76 and/or flows turbulently out of the swirl chamber 76 and/or flows turbulently into the combustion chamber 58. In particular, it is preferably provided that the parts of the air have their turbulent flows in the combustion chamber 58, and thus run turbulently in the combustion chamber 58. The outer swirl chamber 76 has, in particular exactly, one second outflow opening 80 that can be flowed through, in particular along a third flow direction, by the second part of the air flowing through the outer swirl chamber 76, the third through direction of which second outflow opening, along which the outflow opening 80 can be flowed through by the second part of the air flowing through the swirl chamber 76, presently coincides with the axial direction of the swirl chamber 76, and thus with the axial direction of the swirl chamber 62. The third through direction coincides with a third flow direction, along which the second part of the air flowing through the outer swirl chamber 76 flows through or can flow through the outflow opening 80. This means in particular that the first through direction coincides with the third through direction and the first through direction coincides with the second flow direction, such that the first flow direction, the third flow direction, the first through direction and the third through direction presently coincide with the axial direction of the swirl chamber 62 and with the axial direction of the swirl chamber 76. The second outflow opening 80 is arranged downstream of the outflow opening 64 in the flow direction of the parts of the air, and in particular in series or serially with the outflow opening 64, such that the outflow opening 80 can be flowed through by the second part of the air, by the first part of the air and by the fuel. In particular, the first part of the air is in particular mixed with the fuel due to the turbulent first flow already in the swirl chamber 62, in particular while forming a partial mixture. The partial mixture can flow through the outflow opening 64 and thus flow out of the swirl chamber 62, and then flow through the outflow opening 80, and is mixed with the second part of the air, in particular due to the advantageous turbulent second flow, whereby the mixture is particularly advantageously prepared, and thus the partial mixture is particularly advantageously mixed with the second part.

It can be seen that the swirl chamber 76 is at least partially, in particular at least substantially and thus at least more than half or even completely, delimited inwardly in the radial direction of the respective swirl chamber 62 or 76 by the component 74, in particular by the dividing wall 78. The swirl chamber 76 is at least partially, in particular at least substantially or completely, delimited by a component element 82, which is presently designed separately from the component 74, outwards in the radial direction of the respective swirl chamber 62 or 76. The component 74 is at least partially, in particular at least substantially, arranged in the component element 82. The outflow opening 80 is for example partially delimited or formed by the component element 82 and partially by the component 74, in particular with regard to the lowest or smallest flow cross-section of the outflow opening 80 that can be flowed through by the second part.

Figure 3:
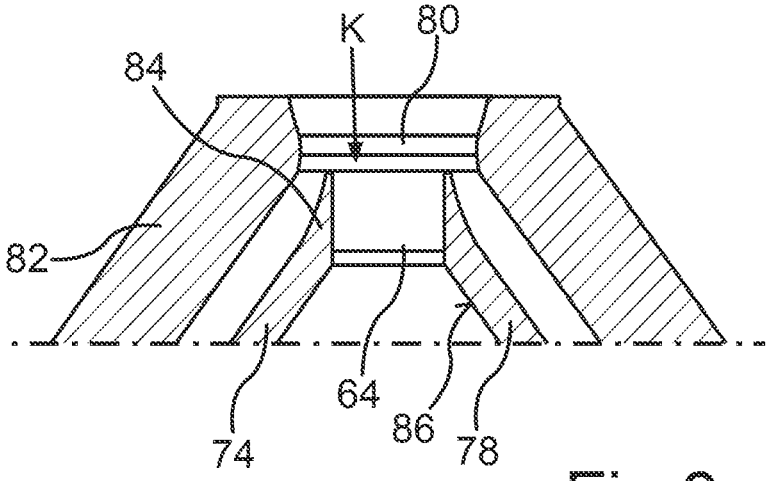
FIG. 3 shows a section of a schematic longitudinal sectional view of the burner according to the first embodiment.

In order for at least the component 36*b* to be able to be heated and/or kept warm particularly efficiently, it is provided that—as can be seen particularly clearly from FIG. 3—the first outflow opening 64 ends in the flow direction of the first part of the air flowing through the first outflow opening 64 and thus in the flow direction of the fuel flowing through the first outflow opening 64 on an end edge K that has been machined in a targeted, in particular mechanical, manner and is thus knife-sharp, the edge for example running completely around the outflow opening 64 in the peripheral direction of the outflow opening 64 running around the axial direction of the outflow opening 64, the axial direction of which coincides with the respective swirl chamber 62 or 76. The knife-sharp end edge K is formed by an atomizing lip 84, which is presently formed by the component 74. The atomizing lip 84 tapers in the flow direction of the first part of the air flowing through the first outflow opening 64, and thus in the flow direction of the fuel flowing through the first outflow opening 64, towards the end edge K, and ends on the end edge K. For example, the end edge K is sanded and/or lathed, and thus mechanically machined in a targeted manner. For example, the fuel is sprayed against the component 74 in particular while forming the fuel jets 72, in particular against a lateral surface 86 of the component 74 on the internal periphery, in particular such that a fuel film also simply described as a film is formed from the fuel on the component 74, in particular on the lateral surface 86 on the internal periphery. It can in particular be seen that the inner swirl chamber 62 is formed, in particular directly, by the lateral surface 86 on the internal periphery outwards in the radial direction of the inner swirl chamber 62. The fuel film is transported by the first turbulent flow, in particular by centrifugal forces resulting from the first turbulent flow, along the lateral surface 86 on the internal periphery to the end edge K, at which the fuel breaks away from the end edge K, whereby particularly tiny droplets of the fuel result from the fuel or from the fuel film. The component 74 is thus a so-called prefilmer or functions as a film layer between the turbulent flows. The droplets in combination form a particularly large surface area of the fuel, such that a particularly efficient operation of the burner can be obtained even at low outputs of the burner, whereby no high-cost pumps or no high-cost high-pressure generation are required to generate the small and thus fine droplets of the fuel. The smallest flow cross-section of the second outflow opening 80 that can be flowed through by the second partial fan is completely delimited or formed inwards by the end edge K in the radial direction of the respective outflow opening 64 or 80.

The burner 42 further has an anti-recirculation plate 88, which, in the first embodiment, is arranged downstream of the outflow opening 80 and downstream of the component element 82 in the flow direction of the parts flowing through the outflow opening 80 and of the fuel flowing through the outflow opening 80. The anti-recirculation plate 88 has a through opening 90, which is correspondingly arranged downstream of the outflow opening 80 and thus can be flowed through by the parts of the air and by the fuel from the swirl chambers 62 and 76. Starting from the through opening 90, and in particular starting from the outflow opening 80 and starting from the component element 82, in particular starting from its end, the anti-recirculation plate 88 extends outwards in the axial direction of the respective swirl chamber 62 or 76, whereby the anti-recirculation plate 88 protrudes outwards beyond at least a partial region T of the component element 82 in the radial direction of the respective swirl chamber 62 or 76. Thus, for example, a first part T1 of the combustion chamber 58 is at least partially separated from the second part T2 of the combustion chamber 58 by means of the anti-recirculation plate 88. By means of the anti-recirculation plate 88, an excessive flow of the mixture flowing through the through opening 90 and into the combustion chamber 58, in particular into the part T2 back in the direction of the component element 82 or back into the part T1 can be avoided, such that an advantageous mixture preparation can be achieved.

It can further be seen from FIG. 2 that for example the swirl chambers 62 and 76 are supplied with the air or the parts of the air via a supply chamber 92 shared by the swirl chambers 62 and 76. The supply chamber 92 is arranged upstream of the swirl chambers 62 and 76 in the flow direction of the parts flowing through the swirl chambers 62 and 76. This means that the air is first introduced into the supply chamber 92 via the air supply path 54. The air that has been introduced into the supply chamber 92 can flow through the supply chamber 92 on its way to and into the swirl chambers 62 and 76 and is divided into the first part and the second part, in particular by means of the component 74. The air flowing through the air supply path 54 can for example flow out of the air supply path 54 along a supply direction and flow into the supply chamber 92, wherein the supply direction for example runs obliquely and/or tangentially to the axial direction of the respective swirl chamber 62 and 76, and thus to their respective longitudinal axis.

Figure 4:
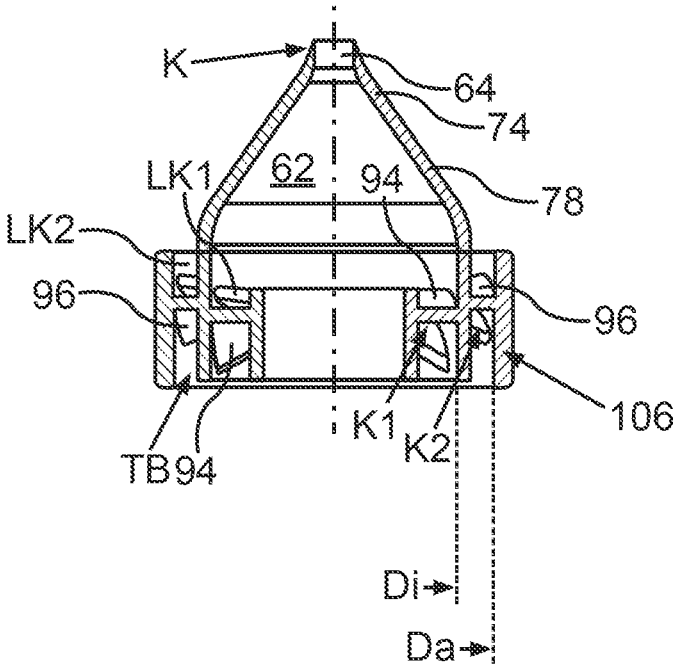
FIG. 4 shows a schematic longitudinal sectional view of a component of the burner according to the first embodiment.

FIG. 4 shows the component 74 also described as a prefilmer in a schematic longitudinal sectional view. It can be seen that at least a part TB of the outer swirl chamber 76 is formed by the component 74. The component 74 has first swirl generators 94 of the inner swirl chamber 62 and second swirl generators 96 of the outer swirl chamber 76. By means of the swirl generators 94, the first turbulent flow of the first part of the air is generated, and by means of the swirl generators 96, the second turbulent flow of the second part of the air is generated. An inner annular surface, in particular the inner swirl chamber 62, is labelled K1 in FIG. 4, and an outer annular surface, in particular the outer swirl chamber 76, is labelled K2 in FIG. 4. The swirl generators 94 are arranged in an air conduit LK1 of the swirl chamber 62, of which the air conduit LK1 is delimited, in particular completely, by the component 74. The air conduit LK1 is in particular delimited outwards and inwards in the radial direction of the respective swirl chamber 62 or 76 by the component 74. The swirl generators 96 are arranged in a second air conduit LK2 of the swirl chamber 76, of which the air conduit LK2 is delimited completely and in particular outwards and inwards in the axial direction of the respective swirl chamber 62 or 76 by the component 74. For example, the swirl generators 94 and 96 are also formed by the component 74. The air conduit LK1 can be flowed through by the first part of the air and the air conduit LK2 can be flowed through by the second part of the air, such that the swirl generators 94 generate or cause the first turbulent flow and the swirl generators 96 generate or cause the second turbulent flow. An outer diameter of the air conduit LK1 also described as an air guide is labelled with Di, and an outer diameter of the air conduit LK2 also described as an air guide is labelled with Da in FIG. 4.

As can be seen from FIG. 2 to 4, the outflow openings 64 and 80 also described as nozzles are both aligned in the axial direction. This means that the partial mixture flows at least substantially in the axial direction out of the inner swirl chamber 62 into the combustion chamber 58. Furthermore, the second part of the air also flows at least substantially in the axial direction out of the outer swirl chamber 76 into the combustion chamber 58 and on the end edge K, in particular on its break-away point, entrains the finely distributed fuel from the prefilmer in small droplets into the combustion chamber 58. The smallest or narrowest flow cross-section of the outer nozzle, and thus of the outflow opening 80, is on the break-away point of the inner nozzle, and thus the outflow opening 64, i.e., the end edge K.

It is preferably provided that the nozzles, and thus the outflow openings 64 and 80, have the following sizes or surface ratios: The outflow opening 64 (inner nozzle) preferably has a diameter, in particular an inner diameter, which has 10 percent to 20 percent of Di. It is also preferably provided that the outer nozzle, and thus the outflow opening 80, has a diameter, in particular an inner diameter that is for example 10 percent to 35 percent of Da. An annular surface area should be coextensive from the inside to the outside, and thus both the inside and the outside should be 50 percent of the entire annular surface area. In other words, it is preferably provided that the air conduit LK1 has a first annular surface area and the air conduit LK2 has a second annular surface area, wherein the annular surface areas are preferably the same size.

Figure 5:
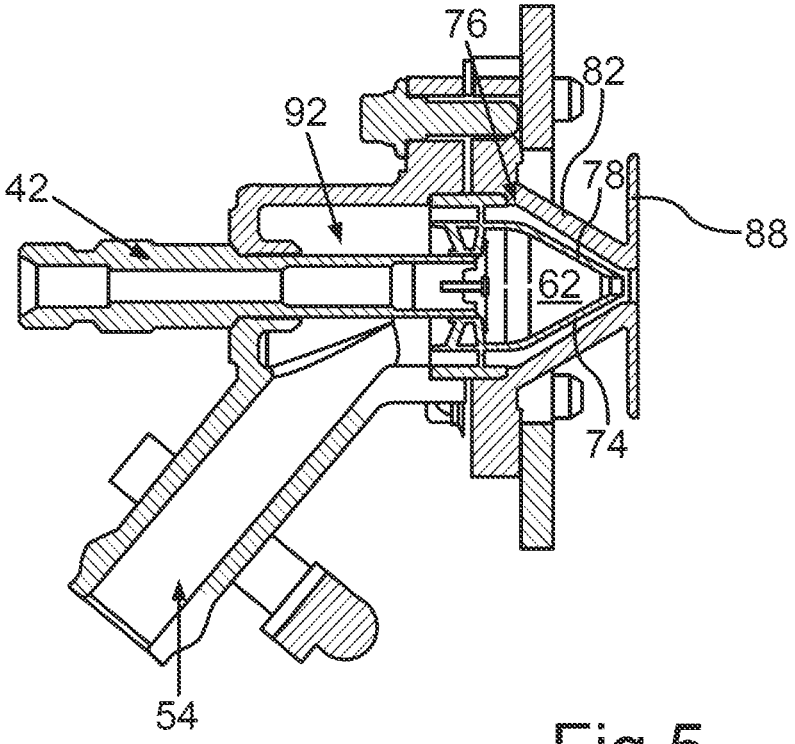
FIG. 5 shows a schematic longitudinal sectional view of a second embodiment of the burner.

FIG. 5 shows a second embodiment of the burner 42 in a schematic sectional view. In the first embodiment, it is provided for example that the component element 82 and the anti-recirculation plate 88 are designed as components that are designed separately from one another and are at least indirectly, in particular directly, connected to each other. In the second embodiment, it is provided that the anti-recirculation plate 88 is designed as one part with the component element 82. In the second embodiment too, it can advantageously be avoided by means of the anti-recirculation plate 88 that the mixture cannot flow backwards back to the component element 82 after exiting from the outer nozzle, and thus from the outflow opening 80 and into the combustion chamber 58 and form a vortex. The anti-recirculation plate 88 also simply described as a plate preferably has a diameter, in particular an outer diameter, that is preferably at least as large as Di.

Figure 6:
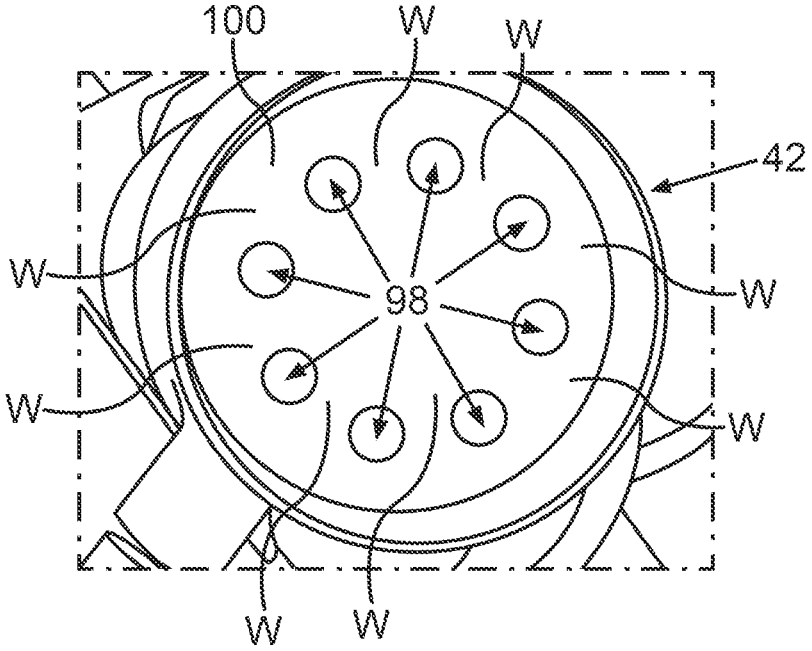
FIG. 6 shows a section of a schematic and perspectival rear view of a third embodiment of the burner.

FIG. 6 shows a section of a third embodiment of the burner 42 in a perspective view. In the third embodiment, the combustion chamber 58 has several through openings 98 that are spaced apart from one another and are separated from one another by respective wall regions W in particular designed as solid bodies, in particular in the radial direction of the respective swirl chamber 62 or 76. Via the through openings 98, the burner exhaust gas or the flame 44 can be removed from the combustion chamber 58 and introduced into the exhaust gas tract 26. The wall regions W are presently designed as one part with one another and formed for example by a perforated disc 100 formed as one part that is designed as a solid body. Precisely eight through openings 98 are preferably provided. As can be seen from FIG. 2, it is conceivable in principle that the combustion chamber 58 has exactly one large and non-subdivided removal opening 102, via which the burner exhaust gas or the flame 44 can be removed from the combustion chamber 58 and introduced into the exhaust gas tract 26. Contrastingly, in the third embodiment, the several through openings 98 are spaced apart from one another and separated from one another, such that the removal opening 102 is effectively subdivided or divided into the several through openings 98 by the wall regions W. It can be seen that the through openings 98 are equally distributed in the peripheral direction running around the axial direction of the respective swirl chamber 62 or 76 and are in particular arranged along a circle, of which the mid-point is arranged in the respective axial direction of the respective swirl chamber 62 or 76. Thus, in the third embodiment, instead of a large exit opening in the form of the large removal opening 102, several exit openings in the form of the through openings 98 are provided, in particular at a respective particular point, to enable an advantageous recirculation in the combustion chamber 58. Instead of a smaller exit opening, it is advantageous to use a perforated plate, e.g., the perforated disc 100 having several smaller openings in the form of the through opening 98. The number of through openings 98 is in a range of three to nine inclusive. The through openings 98 have a similar or at least substantially identical flow surface or exit surface that can be flowed through by the burner exhaust gas or by the flame 44. In total, the through surfaces of the or of all of the through openings 98 results in a total through surface that is described as a total exit surface, and for example, is 0.8 to 1.8 times as large as a single, centrally arranged opening, e.g., the removal opening 102. For example, instead of a central exit opening having a diameter of 25 millimetres, and thus having a surface area of 491 square millimetres, it can be advantageous, depending on flow conditions in the exhaust gas tract 26, to implement six smaller openings having a respective diameter of 10.5 millimetres, such that an entire exit surface of 520 square millimetres is represented.

Figure 7:
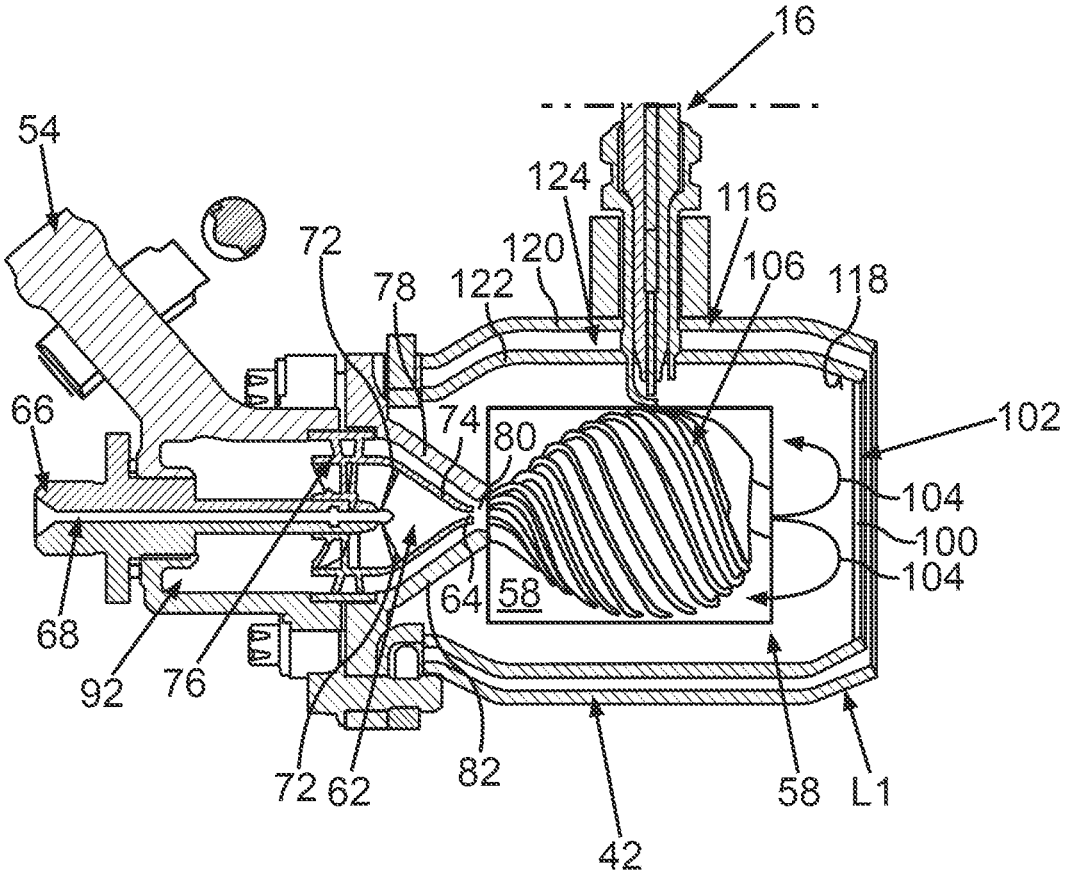
FIG. 7 shows a schematic longitudinal sectional view of the burner according to the third embodiment.

FIG. 7 shows the third exemplary embodiment of the burner 42 in a schematic longitudinal sectional view, wherein the perforated disc 100 also described as a perforated plate is provided. The previously specified advantageous recirculation in the combustion chamber 58 is depicted by an arrow 104 in FIG. 7. In addition, a turbulent flow of the mixture is depicted in FIG. 7 and is labelled with 106, wherein the turbulent flow 106 of the mixture in the combustion chamber 58 results from the respective turbulent flows of the parts of the air. The turbulent flows of the parts of the air, and thus the turbulent flow 106 of the mixture is in particular implemented via the swirl generators 94 and 96 and by the tangential air feed, in particular via the air supply path 54. The respective swirl generator 94 or 96 is preferably designed as an air guide vane, and not as a quarter-spherical sheet-metal construction, such that the respective turbulent flow can be particularly advantageously generated or caused. The turbulent flows of the parts of the air and, resulting from the latter, the turbulent flow 106 of the mixture in the combustion chamber 58 prevents the flame 44 from being blown out in the combustion chamber 58, optimizes a mixing of the air with the fuel in the combustion chamber 58, and generates vortex bursting for stabilising the flame 44. The recirculation in the combustion chamber 58 depicted by the arrows 104 can in particular be implemented by using the perforated plate and, resulting from the latter, a reduction in an exit cross-section, via which the flame 44 or the burner exhaust gas can be removed from the combustion chamber 58 and can be introduced into the exhaust gas tract 26. Reducing the exit cross-section should be understood to mean that, for example, the entire exit surface of the individual through openings 98 is smaller than a surface area of the large continuous removal openings 102. An improved mixing of the air and the fuel in the combustion chamber 58 and a longer dwell time of the burning mixture in the combustion chamber 58 results from the advantageous recirculation in the combustion chamber 58 depicted by the arrows 104, such that when the flame 44 or burner exhaust gas exits from the combustion chamber 58, an excessive emission of non-combusted hydrocarbons (HC) can be avoided in the exhaust gas tract 26, and a particularly high temperature of the flame 44 or of the burner exhaust gas can be implemented on its exit. The recirculation leads in particular to recirculation areas and vortex bursting, whereby a particularly long dwell time of the flame 44 can be implemented in the combustion chamber 58.

Figure 8:
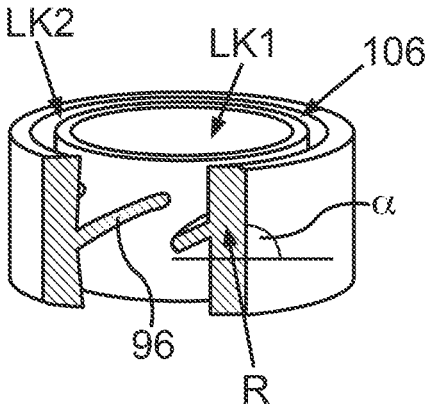
FIG. 8 shows a section of a schematic and partially sectional perspectival rear view of a swirl generation device of the burner.
Figure 9:
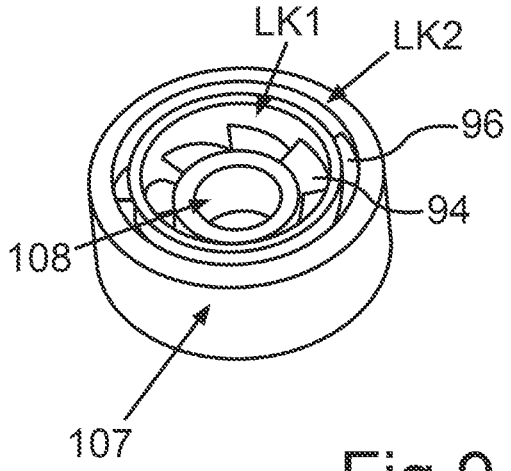
FIG. 9 shows a schematic perspectival view of the swirl generation device.

FIG. 8 shows a swirl generation device 107 in a schematic and partially sectional perspective view, which can for example be a component part of the component 74 or be formed by the component 74. The swirl generation device 107 comprises the swirl generators 94 of the inner swirl chamber 62 and the swirl generators 96 of the outer swirl chamber 76. It can be particularly clearly seen from FIG. 8 that the swirl generators 96 and preferably also the swirl generators 94 are designed as air guide vanes, which can be designed, in particular formed, in a manner favourable to flow. An excessive loss of pressure can thus be avoided, in particular in comparison with spherical swirl generators. The number of swirl generators 94 is for example in a range of six to eleven inclusive. As an alternative or in addition, the number of outer swirl generators 96 is for example in a range of eight to 14 inclusive. The respective air conduit LK1 or LK2, in which the swirl generators 94 or 96 are arranged, has a respective surface area per se, for example, which is covered for example from at least 20 percent to at most 70 percent by the respective swirl generator arranged in the air conduit LK1 or LK2. A particularly advantageous axial obstruction of at least 20 percent and at most 70 percent of the respective surface area is thus provided. A respective radius of the respective air guide vane can extend from at least 40 percent of Di up to an unlimited extent, such that the respective air guide vane can be straight in shape. It is in particular conceivable that the respective air guide vane makes a respective angle $\alpha$ with the respective radial direction of the respective swirl chamber 62 and 76, the angle for example lying in a range of 10 degrees to 45 degrees inclusive. The previously specified radius of the respective air guide vane, also simply described as a vane, is labelled with R in FIG. 8. The swirl generators 94 or 96 are preferably designed to divert the part of the air flowing through the respective air conduit LK1 or LK2, and thus the air flowing through the respective air conduit LK1 or LK2 and forming the respective part, by 70 degrees to 90 degrees, in particular in relation to the strictly or purely axial direction of the respective swirl chamber 62 or 76. To implement a particularly advantageous mixture preparation, the air guide vanes of the inner and outer swirl chambers 62 and 76 can be designed contrary to one another. In other words, it is conceivable that the outer swirl generator 96 of the outer swirl chamber 76 and the inner swirl generator 94 of the inner swirl chamber 62 are designed to form or to cause the turbulent flows of the parts of the air as contrary or opposite turbulent flows, such that, for example, the first flow is counter-clockwise and the second flow is clockwise or vice versa.

The swirl generation device 107 has an in particular central through opening 108, which is passed through by the injection element 66. In other words, the injection element 66 protrudes through the through opening 108 into the inner swirl chamber 62.

Figure 10:
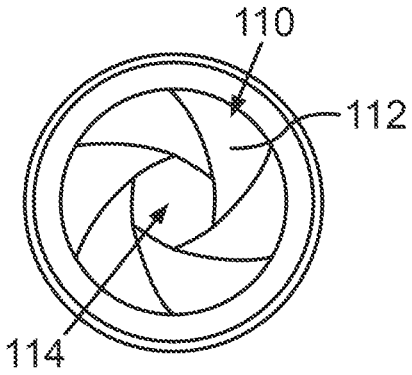
FIG. 10 shows a schematic front view of a closing device.

FIG. 10 shows a closing device 110 in a schematic front view that is presently designed as an iris diaphragm or in the manner of an iris diaphragm. If the burner 42 is not operated, it can be advantageous to block an air conduit and a fuel conduit, i.e., for example the air supply path 54 and/or the fuel supply path 46 and/or the swirl chambers 62 and 76, and for example the outflow opening 64 and/or the outflow opening 80 to avoid exhaust gas of the internal combustion engine 12 entering the air supply path 54, the fuel supply path 46, the supply chamber 92, the swirl chamber 62 and/or the swirl chamber 76. It is further conceivable to block the combustion chamber 58 or at least one longitudinal region of the combustion chamber 58 to avoid exhaust gas of the internal combustion engine 12 entering the combustion chamber 58 or its partial region or longitudinal region from the exhaust gas tract 26. For this purpose, the closing device 110 can be used, the closing device for example being able to be arranged in the combustion chamber 58 or downstream of the combustion chamber 58. Closing elements 112 of the closing device 110, the closing elements being able to be moved in the manner of an iris diaphragm, can vary, i.e., variably adjust an opening cross-section 114 that can be flowed through by the flame 44 or by the burner exhaust gas and is delimited, in particular directly, by the closing elements 112, whereby for example the opening cross-section 114 can be adjusted, in particular controlled or regulated depending on load. It is thus conceivable to close at least a partial region of the combustion chamber 58 by means of the closing device 110. As an alternative or in addition, the outflow opening 80 can for example be closed by means of a first closing device 110. As an alternative or in addition, the outflow opening 80 can for example be closed by means of a second closing device 110. This in particular has the advantage that an air and fuel supply can be simultaneously blocked by means of a small stopper. No air valve downstream of the pump 56 is needed either, as it prevents an entry of exhaust gas into the pump 56. A much larger exhaust gas flap that is exposed to hot exhaust gas after the combustion chamber 58 or after its exit is also not required.

It is in particular conceivable that the opening cross-section 114 is an opening cross-section or exit cross-section, in particular of the combustion chamber 58, wherein the flame 44 or the burner exhaust gas can be removed from the combustion chamber 58 and introduced into the exhaust gas tract 26 via the exit cross-section. A tapering of the opening cross-section that is necessary, required or carried out to increase a flow velocity of the flame 44 or of the burner exhaust gas from the combustion chamber 58, in particular by corresponding movement of the closing elements 112 being implemented in the manner of an iris diaphragm should be represented in a manner favourable to flow. Thus, a conical outlet having an angle of 30 degrees to 70 degrees to the horizontal could be implemented instead of a hole in a flat closing plate, as is implemented, for example, by segments and/or by a cone in an aircraft engine. This can be implemented by a fixed geometry or variably, as in an aircraft engine having individual segments, the segments being foldable, for example in a thrust nozzle, or having a shiftably arranged exit cone that can for example be shifted in the axial direction of the respective swirl chamber 62 or 76.

Figure 11:
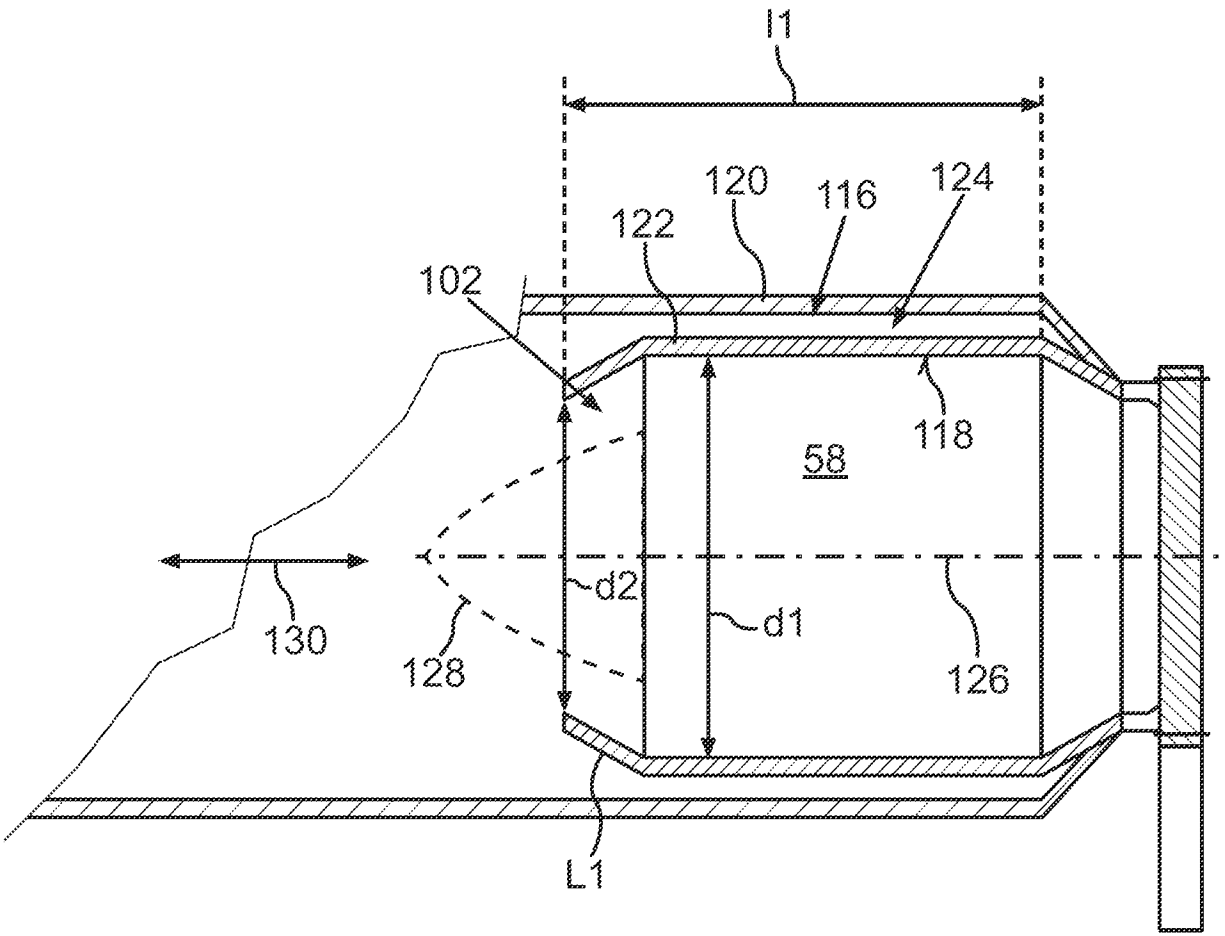
FIG. 11 shows a section of a schematic longitudinal sectional view of a fourth embodiment of the burner.

FIG. 11 shows a section of the burner 42 according to a fourth embodiment in a schematic sectional view. It can be seen particularly clearly from FIG. 11, but also from FIGS. 2 and 7, that the combustion chamber 58 is formed or delimited by a chamber element 116 in particular designed as a solid body. In particular, the combustion chamber 58, of which the axial direction coincides with the axial direction of the respective swirl chamber 62 or 76, is delimited, in particular directly, along its radial direction running in parallel with the respective radial direction of the respective swirl chamber 62 or 76 by a lateral surface 118 of the chamber element 116 on the internal periphery. The chamber element 116 can be designed as one-part. In the fourth embodiment, the chamber element 116 is designed such that it has two chamber parts 120 and 122 that are for example designed as one part with one another, or the chamber parts 120 and 122 are component parts that are designed separately from one another and connected to one another. The lateral surface 118 on the internal periphery is formed by the chamber part 122. The chamber parts 120 and 122 are arranged within one another, such that at least one longitudinal region of the chamber part 120 surrounds at least one longitudinal region of the chamber part 122 in the peripheral direction of the combustion chamber 58 running around the axial direction of the combustion chamber 58, in particular completely continuously, wherein at least the longitudinal region of the chamber part 120 is spaced apart from the longitudinal region of the chamber part 122 outwards in the radial direction of the combustion chamber 58, in particular while forming a clearance 124. The clearance 124 is arranged in the radial direction of the combustion chamber 58 between the chamber parts 120 and 122, and is for example designed as an air gap, in particular between the chamber parts 120 and 122. It can further be seen that the removal opening 102 that is continuous per se or uninterrupted, is formed or delimited by the chamber part 122 in particular completely continuously in the peripheral direction of the combustion chamber 58. In the first embodiment shown in FIG. 2, the removal opening 102 is not subdivided, i.e., is free of a component subdividing the removal opening 102 into several through openings separated from one another and spaced apart from one another. In the third embodiment shown in FIG. 7, however, the perforated disc 100, also described as a perforated plate, is arranged in the removal opening 102, by means of which disc the removal opening 102 that is uninterrupted per se, i.e., continuous, is subdivided or divided into the several through openings 98 spaced apart from one another and separated from one another that are formed in the perforated disc 100. The flame 44 or the burner exhaust gas can flow out of the combustion chamber 58 along a fourth flow direction running in the axial direction of the combustion chamber 58, i.e., running in parallel with the axial direction of the combustion chamber 58 or coinciding with the axial direction of the combustion chamber 58, and can flow through the removal opening 102 or through the respective through opening 98, wherein the fourth flow direction coincides with the first, second and third flow direction. It can be seen that the removal opening 102 tapers in the flow direction of the burner exhaust gas flowing through the removal opening 102, i.e., along the fourth flow direction. For this purpose, the chamber element 116, in particular the chamber part 120, has a longitudinal region L1 tapering in the flow direction of the burner exhaust gas flowing through the removal opening 102, the longitudinal region delimiting the removal opening 102 in the peripheral direction of the combustion chamber 58, in particular completely continuously. In other words, the longitudinal region L1, and thus the removal opening 102, are conical, i.e., cone-shaped or truncated cone-shaped in the flow direction of the burner exhaust gas flowing through the removal opening 102. As the burner exhaust gas or the flame 44 flows out of the combustion chamber 58 via the removal opening 102, the removal opening 102 is formed on an exit of the combustion chamber 58 or forms an exit of the combustion chamber 58, wherein in the fourth embodiment, the combustion chamber 58 is conical in shape at its exit, and thus has a cone formed by the longitudinal region L1. The removal opening 102 preferably has an internal diameter of 34 mm. In other words, it is preferably provided that the smallest or narrowest internal diameter of the removal opening 102 that can be flowed through by the burner exhaust gas is 43 mm.

As at least the longitudinal regions of the chamber parts 120 and 122 are arranged within one another, and are spaced apart from one another in the radial direction of the combustion chamber 58 while forming the clearance 124, wherein the clearance 124 is for example filled with air and thus designed as an air gap, a double wall of the combustion chamber 58 or of the chamber element 116 is created, whereby the combustion chamber 58 is insulated by the clearance 124, i.e., by the air gap. The combustion chamber 58 is thus insulated by air gap. In the following, reference is made in particular to the outer diameter Da shown in FIG. 4 of the prefilmer, in particular of the outer air conduit LK2 of the outer swirl chamber 76, wherein the air conduit LK2 in which the outer swirl generators 96 are arranged, and thus the outer diameter Da, are formed, in particular completely, by the prefilmer, i.e., by the component 74. With reference to FIG. 11 and the outer diameter Da, the combustion chamber 58 preferably has an inner diameter d1 that is preferably 1.0 times to 3.0 times Da, in particular upstream of the cone or upstream of the longitudinal region L1. It is further preferably provided that the smallest inner diameter d2 of the removal opening 102, wherein the smallest inner diameter d2 of the removal opening 102 is also described as an exit diameter, is 0.7 times to 2.3 times Da. A smaller exit diameter of the removal opening 102 maintains the exit velocity of the burner exhaust gas and reduces the influence of the flame 44, also described as a burner flame, by the exhaust gas, also described as engine exhaust gas, of the internal combustion engine 12. A length 11 of the combustion chamber 58 running in the axial direction of the combustion chamber 58 is preferably 1.5 to 4.0 times Da, in particular without secondary air injection. It is preferably provided with secondary air injection that the length 11 of the combustion chamber is 2.0 to 5.5 times Da.

Instead of the continuous removal opening 102, it is conceivable to use the several through openings 98 separated from one another and spaced apart from one another. In other words, it is conceivable that the removal opening 102 that is continuous per se and thus uninterrupted is divided into the several through openings 98 that are spaced apart from one another and separated from one another, the number of the through openings preferably lying in a range of 3 to 9 inclusive. The respective through opening 98 has a surface area, also described as an exit surface or through surface, wherein the sum of the surface areas of all of the through openings 98 is preferably the same as the exit surface of the continuous removal openings 102, i.e., the same as the surface area of the removal opening 102. The sum of the surface areas of the through openings 98 is also described as a total exit surface. The through openings 98 are for example designed as holes. It is conceivable that the sum of the surface areas of all of the through openings 98, i.e., the total exit surface, is 0.8 times to 1.8 times the surface area of the or of an uninterrupted, continuous removal opening of the removal opening 102 of the combustion chamber 58. It is in particular conceivable that the perforated disc 100 is arranged in the removal opening 102 or in the longitudinal region L1. With regard to the exhaust gas also described as engine exhaust gas, it can be advantageous for the internal combustion engine 12 to use a deflection element, in particular a deflection element and/or a perforated element, in particular a perforated sheet, wherein the perforated element can in particular be understood to mean an element formed as a solid body that has several holes spaced apart from one another and in particular separated from one another via respective walls, the holes being able to be flowed through by a gas, e.g., the burner exhaust gas or the engine exhaust gas. So that the engine exhaust gas does not excessively negatively influence and destabilize the flame 44 in the combustion chamber 58, for example, it is advantageous to provide a deflection element, e.g., a deflection sheet, in front of the combustion chamber 58, i.e., upstream of the combustion chamber 58, so that the engine exhaust gas cannot or can only slightly enter the combustion chamber 58, in particular against the flow direction, along which the flame 44 or the burner exhaust gas flows out of the combustion chamber 58 into the exhaust gas tract 26. It is thus preferably provided that the deflection element is arranged upstream of the combustion chamber 58, i.e., upstream of the introduction point E2, in the exhaust gas tract 26 in the flow direction of the engine exhaust gas. A geometry of the deflection element can depend on how the combustion chamber 58 is arranged in relation to the exhaust gas tract 26, i.e., in relation to an exhaust gas conduit of the exhaust gas tract 26. The exhaust gas conduit should be understood to mean that the burner exhaust gas or the flame 44 flows out of the combustion chamber 58, in particular along the fourth flow direction, into the exhaust gas conduit, in particular at the introduction point E2. An individual adjustment of the geometry of the deflection element is advantageous.

It is further advantageous, as previously described, that the closing device 110 or another closing device is arranged on the exit of the combustion chamber 58. This should in particular be understood to mean the following: The closing device 110 can for example be arranged in the longitudinal region L1 or in the removal opening 102, such that a flow cross-section, which can be flowed through by the burner exhaust gas or by the flame 44 and via which the burner exhaust gas or the flame 44 can be removed from the combustion chamber 58, in particular at the introduction point E2, and can be introduced into the exhaust gas tract 26, in particular into the exhaust gas conduit, is delimited by the closing device 110, in particular by the closing elements 112, and can consequently be varied, i.e., can be adjusted, by means of the closing device 110. The adjustable flow cross-section is in particular the opening cross-section 114.

The closing device 110 can be arranged in the chamber part 122 and in the removal opening 102, or the closing device 110 or another closing device is arranged downstream of the combustion chamber 58, i.e., downstream of the chamber part 122 and directly connected to the combustion chamber 58 or to the chamber part 122, and is thus arranged downstream of the removal opening 102 per se. A tapering of the removal opening 102, as is implemented in the fourth embodiment by the longitudinal region L1, i.e., by the cone described, leads to an increase of the flow velocity of the burner exhaust gas, wherein the tapering of the exit of the combustion chamber 58 should be depicted in a manner favourable to flow. The cone presently formed by the longitudinal region L1 preferably has an angle, also described as a cone angle, in particular to the axial direction of the combustion chamber 58, in particular depicted in FIG. 11 by a dashed line 126, of 30° to 70°. In the fourth embodiment, the cone is formed as a fixed geometry, such that the cone, i.e., the cone angle is fixed, i.e., is not variable. It is conceivable, however, to form the cone variably, e.g., as in an aircraft engine, in particular with regard to its cone angle, in particular via individual segments, which can for example be folded, i.e., can in particular be pivoted relative to the chamber part 122 as in a thrust nozzle in an aircraft engine, whereby the cone or the cone angle can be adjusted, i.e., can be varied. As an alternative or in addition, it can be provided that the cone or its cone angle can be varied by a shiftably arranged exit cone and/or that an exit cone is provided of which the longitudinal central axis coincides for example with the axial direction of the combustion chamber 58 and/or can be shifted in the axial direction of the combustion chamber 58, in particular relative to the chamber element 116, wherein the exit cone, which is preferably arranged coaxially with the combustion chamber 58, tapers in the flow direction of the burner exhaust gas flowing through the removal opening 102. The feature that the exit cone is arranged coaxially with the combustion chamber 58 should in particular be understood to mean that the axial direction of the exit cone, and thus of its longitudinal central axis, coincides with the axial direction of the combustion chamber 58. By shifting the exit cone in the axial direction of the combustion chamber 58 relative to the chamber element 116, the flow cross-section that can be flowed through by the burner exhaust gas and via which the burner exhaust gas can be removed from the combustion chamber 58 and can be introduced into the exhaust gas conduit can for example be varied. The exit cone is shown particularly schematically and is labelled with 128 in FIG. 11. A movement direction running in parallel with the axial direction of the combustion chamber 58 or coinciding with the axial direction of the combustion chamber 58 and along which the exit cone 128 can be moved, in particular shifted, translationally relative to the chamber element 116 is depicted in FIG. 11 by a double arrow 130. It can be recognized that in the radial direction of the combustion chamber 58, the flow cross-section that can be flowed through by the burner exhaust gas is delimited outwards by the chamber element 116 and is delimited inwards by the exit cone 128, in particular respectively directly, with the flow cross-section being annular or annular-surface shaped. As the exit cone 128 tapers in the flow direction of the burner exhaust gas flowing through the removal opening 102 or the flow cross-section, the flow cross-section is varied by shifting the exit cone 128 implemented along the movement direction and relative to the chamber element 116.

Figure 12:
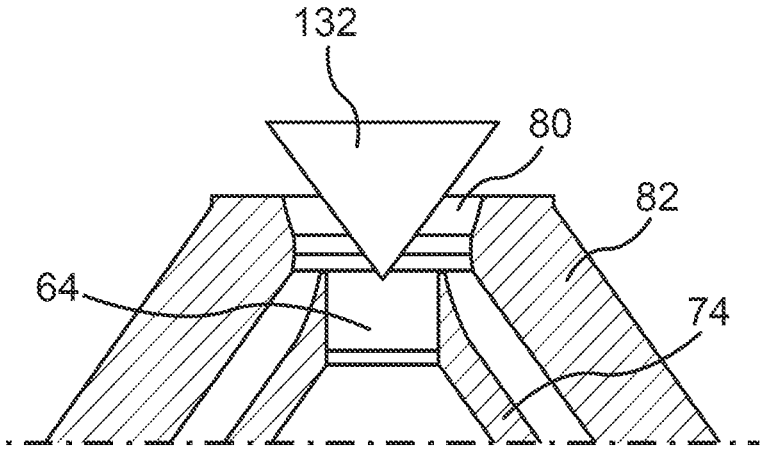
FIG. 12 shows a section of a schematic sectional view of a fifth embodiment of the burner.

FIG. 12 shows a section of a fifth embodiment of the burner 42 in a schematic sectional view. The component 74 and the component element 82 can in particular be partially seen in FIG. 12, in particular as in FIG. 3. If the burner 42 is not operated, it is advantageous to close an air and fuel conduit, i.e., preferably the outflow openings 64 and 68, to prevent the engine exhaust gas from penetrating the swirl chambers 62 and 76. For this purpose it is conceivable that for example a closing device 110 is respectively arranged in the outflow opening 64 and/or in the outflow opening 80, or the closing device 110 is arranged downstream of the outflow opening 80 and directly connected to the outflow opening 80, such that for example a first flow cross-section that can be flowed through by the first part of the air and the fuel, in particular of the outflow opening 64, and/or a second flow cross-section that can be flowed through by the parts of the air and by the fuel, in particular of the outflow opening 80, or a third flow cross-section that can be flowed through by the parts of the air and by the fuel and is arranged downstream of the outflow opening 80 and immediately or directly connected to the outflow opening 80 is variable or can be adjusted by means of the closing device 110. The first, second or third flow cross-section is for example the opening cross-section 114, i.e., in particular the opening cross-section 114 of an opening having the opening cross-section 114, of which the flow cross-section (opening cross-section 114) and thus the surface area can in particular be adjusted in the manner of an iris diaphragm by means of the closing elements 112. The respective first, second or third flow cross-section can be adjusted, in particular controlled or regulated, in particular depending on load. For example, it is conceivable to only close the two outflow openings 64 and 80, also described as exit nozzles, by means of the closing device 110 or by means of another, further closing device, and thus to reduce the first, second or third flow cross-section to zero.

The further closing device can for example be a closing element depicted particularly schematically in FIG. 12 and labelled with 132, which is also described as a closing stopper. The closing element 132 can for example be moved, in particular in the axial direction of the respective swirl chamber 62 or 76, relative to the component element 82 and relative to the component 74, in particular translationally, in particular between at least one closed position and at least one open position shown in FIG. 12. In the closed position, the outflow openings 64 and 80 are closed by the closing element 132 and thus fluidically blocked, in particular while the burner 42 is deactivated. No engine exhaust gas can thus flow through the outflow openings 64 and 80 out of the exhaust gas tract 26. In the open position, the closing element 132 releases the outflow openings 64 and 80, in particular while the burner 42 is operated. It can be seen that the outflow openings 64 and 80 can be or are simultaneously closed by means of the closing element 132 for example designed as a small stopper, in particular in the closed position of the closing element 132. No air valve, such as the valve element 55, is required downstream of the pump 56, as it can be avoided by means of the closing element 132 that engine exhaust gas flows out of the exhaust gas tract 26 through the air supply path 54. In other words, it can be avoided by means of the closing element 132 or by means of the closing device 110 that engine exhaust gas from the exhaust gas tract 26 penetrates the pump 56. A much larger exhaust gas flap to which hot exhaust gas is applied is also not required downstream of the combustion chamber 58, i.e., after its exit.

In the following, the previously specified air gap insulation of the combustion chamber 58 is explained in more detail: As the combustion chamber 58 becomes very hot on its outer wall and optionally glows, especially in its full power operation, the air gap insulation can guarantee a particularly safe operation. Heat loss can additionally be kept particularly low by the air gap insulation. It is preferably provided that an in particular thermal insulation surrounds the combustion chamber 58 in the peripheral direction running around the axial direction of the combustion chamber 58, in particular completely continuously. The air gap insulation, and thus the air gap, is provided as this insulation in the present case. The clearance 124 presently designed as an air gap preferably has a width, in particular a gap width, running in the radial direction of the combustion chamber 58, wherein the width, in particular the gap width, is preferably 6% to 25% of Da. It is in particular conceivable that the width lies in a range of 1.5 mm to 6 mm inclusive. It can in particular be seen that the chamber element 116 is a double-walled and thus air gap-insulated pipe. In other words, the chamber parts 120 and 122 form a double-walled and thus air gap-insulated pipe. It is preferably provided that an insulating element formed separately from the chamber element 116 (air gap-insulated pipe) surrounds the air gap-insulated pipe (chamber element 116), i.e., at least one longitudinal region of the chamber element 116 running in the axial direction of the combustion chamber 58, in the peripheral direction of the combustion chamber 58, in particular completely continuously. The insulation element is preferably an insulation mat. The insulation element is preferably formed at least from mineral wool and/or sheet metal, whereby the combustion chamber 58 can be particularly advantageously insulated.

In the following, a possible installation position of the combustion chamber 58 or of the burner 42 is described. As has previously been described, the mixture in the combustion chamber 58 is too thin to combust while releasing heat or heat energy. By means of the heat energy, at least the component **36*b* can for example be effectively and efficiently heated and/or kept warm. As an alternative or in addition, the component 36*c* for example designed as a particle filter can be heated. By heating the particle filter, a regeneration of the particle filter can for example be caused or carried out. So that the heat energy of the burner 42 can now be advantageously used, the latter or the introduction point E2 should be arranged as close as possible to the component to be heated or kept warm, such as for example the component 36*b* and/or 36*c*. Heat losses can thus also be kept low. To guarantee an advantageous mixing of the engine exhaust gas with the burner exhaust gas, however, a minimum distance to the mixing of the burner exhaust gas with the engine exhaust gas should be provided, wherein this minimum distance extends in particular in the flow direction of the engine exhaust gas flowing through the exhaust gas tract 26 from the burner 42 or from the introduction point E2, in particular continuously, to the component to be heated or to be kept warm, e.g. the component 36*b*, in particular to its entrance. In particular, the minimum distance is a minimum distance of the mixing chamber 40. The introduction point E2 thus cannot advance directly to the entrance of the component 36*b*. It has proved particularly advantageous if a spacing running in particular in the flow direction of the exhaust gas flowing through the exhaust gas tract 26 between the introduction point E2 and the component 36*b* immediately following the introduction point E2 in the flow direction of the exhaust gas tract 26 is at least 5 to 8 times Da and at most 30 times Da. The feature that the component 36*b* is immediately or directly connected to the introduction point E2 in the flow direction of the exhaust gas (engine exhaust gas) flowing through the exhaust gas tract 26 should be understood to mean that no other, further exhaust gas aftertreatment component is arranged in the flow direction of the exhaust gas flowing through the exhaust gas tract 26 between the introduction point E2 and the component 36*b*. As an alternative or in addition, a diameter, in particular an inner diameter, of the exhaust gas conduit in which the introduction point E2 is arranged should broaden conically to at least 6 times Da, in particular after it exits the combustion chamber 58, in particular before the exhaust gas enters the component 36*b***. In particular if the component

36*b* is a catalyst, in particular the previously specified SCR catalyst, the component 36*b* has a substrate. It is thus preferably provided that the previously specified spacing is a spacing running in particular in the flow direction of the exhaust gas flowing through the exhaust gas tract 26 between the introduction point E2 and the substrate of the catalyst. It is thus advantageous if the inner diameter of the exhaust gas conduit broadens to at least 6 times Da after exiting the combustion chamber 58, i.e., for example starting from the introduction point E2, before the exhaust gas (engine exhaust gas or burner exhaust gas) is applied to the substrate.

It can be seen from FIG. 2 that the ignition device 60 for example designed as a spark plug, glow plug or glow element has a thread 134 in particular designed as an outer thread, by means of which the ignition device 60 is at least in directly screwed to the chamber element 116 and is thus held on the chamber element 116. To obtain a sufficient cooling of the ignition device 60, i.e., an advantageous heat removal from the ignition device 60, it is advantageous if cooling ribs are applied on the thread 134 of the ignition device 60 also described as a spark plug thread. The number of cooling ribs preferably lies in a range of 1 to 7 inclusive. For example, the cooling ribs have a thickness that lies in a range of 2 to 4 mm inclusive. It is further conceivable that the respective cooling rib has a diameter, in particular an outer diameter, of 20 to 80 mm. It is additionally advantageous if the individual cooling ribs have openings, in particular through openings, designed in particular as holes to achieve advantageous heat removal in an environment of the ignition device 60, i.e., ambient air, the number of which openings lies in a range of 3 to 8 inclusive. The respective through opening of the respective cooling rib for example has a diameter, in particular an inner diameter, that is at least 5 mm and at most 15 mm. An electrode spacing between electrodes of the ignition device 60 is at least 0.7 mm and at most 10 mm. The electrodes can be seen from FIG. 2 and are labelled 136 and 138, wherein the ignition spark for igniting the mixture in the combustion chamber 58 is generated by means of the electrodes 136 and 138, in particular between the electrodes 136 and 138.

To support the causation or generation of the turbulent flows of the parts of the air in the swirl chambers 62 and 76, the air should not be introduced strictly radially, i.e., in the radial direction of the respective swirl chambers 62 or 76 into the respective swirl chamber 62 or 76, but tangentially or obliquely to the respective axial direction of the respective swirl chamber 62 or 76, as is depicted in FIG. 2. In other words, it is advantageous if the air or the respective part of the air flows into the respective swirl chamber 62 or 76 tangentially. A surge of the entering air can thus additionally be directed in the swirl direction, which results in the swirl generation being particularly highly effective.

To provide the burner 42 with the fuel, a fuel pump, e.g., a propellant pump, is used to feed the fuel from the tank 18. The fuel pump can thus for example be the low-pressure pump 20. It is advantageous to operate the burner 42 in a lambda-controlled manner, such that for example the mixture has a fuel-air ratio ($\gamma$) of substantially at least 1.0. In other words, it is preferably provided that the burner is operated stoichiometrically, and the mixture is thus a stoichiometric mixture. In other words again, it is advantageously provided if a first portion of the air in the mixture and a second portion of the fuel in the mixture can be adjusted or regulated particularly precisely. It is advantageous if the first quantity of the air, also described as combustion air, of the mixture and a second quantity of the fuel of the mixture are at least substantially precisely adjusted and/or calculated and are introduced into the respective, corresponding swirl chamber 62 or 76. It is thus advantageous to use a frequency-controlled piston pump as the fuel pump for feeding the fuel to or into the burner 42. The frequency-controlled piston pump should be provided with a spring-loaded valve, e.g., a ball valve, on its exit, to prevent fuel or exhaust gas from flowing back, in particular into the fuel pump.

Figure 17:
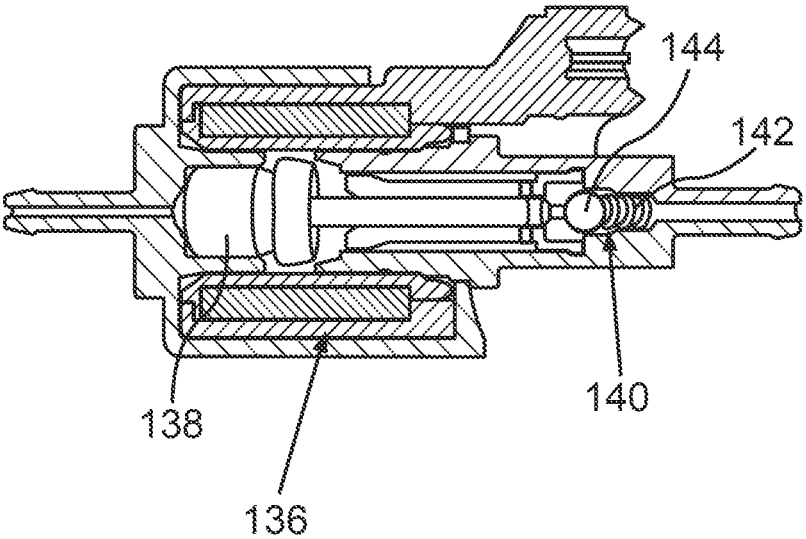
FIG. 17 shows a schematic sectional view of a fuel pump for feeding a fuel to the burner.

Such a fuel pump is shown in FIG. 17 in a schematic longitudinal sectional view and is labelled 137. The fuel pump 137 is designed as a piston pump, of which the piston for feeding the fuel is labelled 138. The spring-loaded valve, which is designed as a spring-loaded ball valve in the exemplary embodiment shown in FIG. 17, is labelled 140 in FIG. 17 and comprises an in particular mechanical spring unit 142 and a ball 144. The spring-loaded valve 140 is in particular designed as a return valve or functions as a return valve, such that the fuel can be fed to the burner 42 by means of the fuel pump 137, such that the valve 140 opens in the direction of the burner, but blocks it in the opposite direction, such that no exhaust gas and no air can flow out of the burner 42 back into the fuel pump 137.

Figure 13:
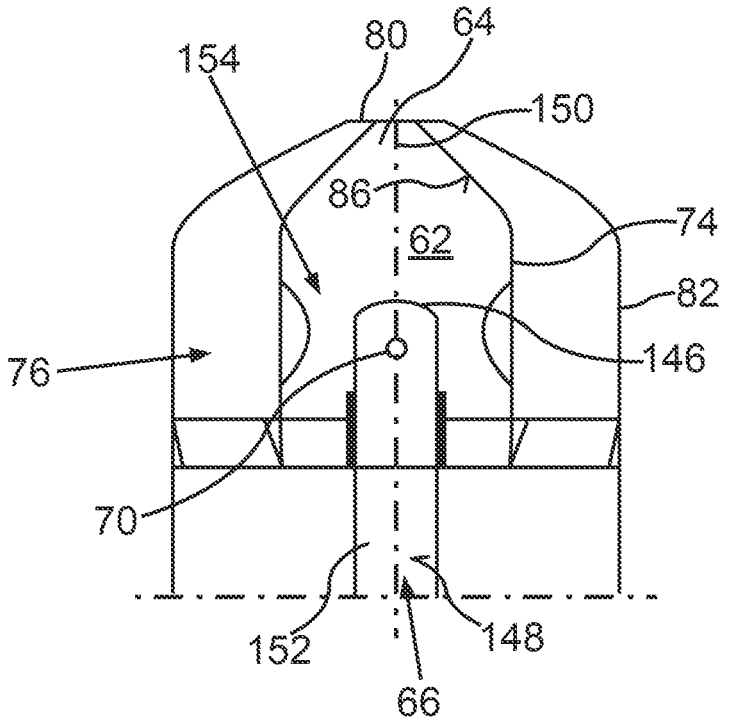
FIG. 13 shows a section of a schematic longitudinal sectional view of a sixth embodiment of the burner.

FIG. 13 shows a section of a schematic longitudinal sectional view of a sixth embodiment of the burner 42, wherein the outflow openings 64 and 80 and thus the component element 82 and the component 74 can in particular be seen in FIG. 6 and in FIG. 12. The injection element 66 can also be seen from FIG. 13, the injection element being designed however according to FIGS. 2 and 7 as a lance in the exemplary embodiment shown in FIG. 13. The exit openings are not arranged or formed on an axial end face 146 of the injection element 66 aligned in the axial direction of the swirl chambers 62 or 76, but the exit openings 70 are aligned in the radial direction of the swirl chambers 62 or 76 and formed in a lateral surface 148 of the injection element 66 on the outer periphery, the lateral surface 148 on the outer periphery of the injection element extending around the axial direction of the peripheral direction running around the axial direction of the respective swirl chamber 62 or 76. In other words, the respective fuel jet 72 does not exit the injection element 66 at the end face 146 and not in the axial direction or not in parallel with the axial direction of the respective swirl chamber 62 or 76, and instead the fuel jet 72 exits the injection element 66 perpendicular or presently obliquely to the axial direction of the respective swirl chamber 62 or 76 depicted by a dashed line 150 in FIG. 13.

The lateral surface 86 on the internal periphery of the component 74 is also described as a film wall, as the fuel that is injected out of the injection element 66 via the exit openings 70 and is applied or injected against the film wall forms the previously specified film or fuel film on the film wall (lateral surface 86 on the internal periphery). To apply the fuel particularly advantageously on or against the film wall, a simple lance, e.g., the injection element 66 shown in FIG. 13, can for example be used instead of an atomizing nozzle. The lance comprises a tube 152, in the end region of which the at least two exit openings 70, for example designed as transverse holes, are applied. The fuel does not exit the lance or the tube 152 in the axial direction of the respective swirl chamber 62 or 76, and instead exits in the radial direction or obliquely to the radial direction of the respective swirl chamber 62 or 76. So that the fuel exiting the exit openings 70 can be particularly effectively applied on the prefilmer and in particular on or against the film wall, it is advantageous if the fuel is atomized. For this purpose, it is preferably provided that if a venturi nozzle 154 is arranged on or at the film wall also described as a prefilmer wall, the venturi nozzle is in particular arranged at the height of the exit openings 70 in the axial direction of the respective swirl chamber 62 or 76 of which the respective axial direction coincides with the axial direction and with the longitudinal extension direction of the injection element 66, in particular of the tube 152, the exit openings preferably being arranged at the same height in the axial direction. In other words, the venturi nozzle 154 is preferably provided in the swirl chamber 62 in which the exit openings 70 are also arranged, the narrowest flow cross-section of which venturi nozzle that can be flowed through by the first part of the air preferably being arranged in the axial direction of the respective swirl chamber 62 or 76, and thus of the injection element 66 such that the narrowest or smallest or lowest flow cross-section of the venturi nozzle 154 and the respective exit opening 70 are arranged at the same height in the axial direction of the respective swirl chamber 62 or 76 and thus in the axial direction of the injection element 66. A particularly advantageous atomization of the fuel flowing through the exit openings 70 can thus be obtained. The venturi nozzle 154 and the injection element 66 can in particular function as a kind of jet pump. The first part of the air flows through the venturi nozzle 154, i.e., through its narrowest flow cross-section. As the exit openings 70 are respectively at least partially arranged in the narrowest flow cross-section of the venturi nozzle 154, i.e., as the narrowest flow cross-section of the venturi nozzle 154 and the exit openings 70 are arranged at the same height in the axial direction of the injection element 66 and thus the flow direction of the first part of the air flowing through the venturi nozzle 154, the first part of the air acts or functions as a propellant that suctions the fuel as a suction medium, so to say, in particular via the exit openings 70, such that the propellant suctions the suction medium (fuel) through the exit openings 70, so to say. The fuel is thus particularly advantageously atomized in the swirl chamber 62.

Figure 14:
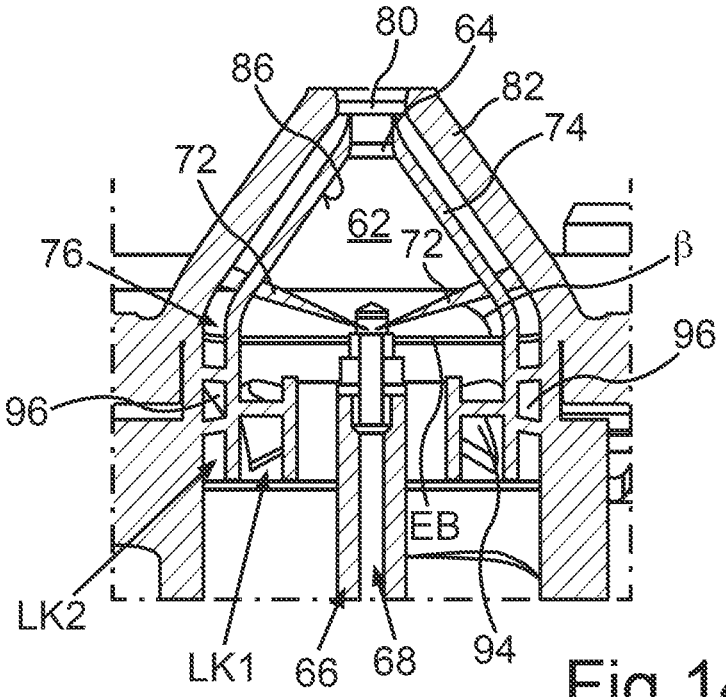
FIG. 14 shows a section of a schematic longitudinal sectional view of a seventh embodiment of the burner.

FIG. 14 shows a section of a seventh embodiment of the burner in a schematic longitudinal sectional view. In the seventh embodiment, the injection element 66 is for example designed as a lance. It can be seen that the respective fuel jet 72, in particular its longitudinal axis or longitudinal central axis, forms an angle 3, also described as a jet angle, with a n imaginary plane EB running perpendicular to the axial direction of the respective swirl chamber 62 or 76, and thus perpendicular to the respective flow direction of the respective part of the air flowing through the respective swirl chamber 62 of 76. The axial direction of the respective swirl chamber 62 or 76 coincides with the longitudinal extension direction or longitudinal extension of the injection element 66, and thus with its axial direction. The exit openings 70 are arranged distributed and spaced apart from one another in the peripheral direction running around the axial direction of the injection element 66, in particular equally. To generate as thin and as even a fuel film as possible on the prefilmer, i.e., on the lateral surface 86 on the internal periphery, the number of exit openings 70 is preferably at least 2 and at most 10. In other words, it is for example provided that the number of exit openings 70 lies in a range of 2 to 10 inclusive. For example, it is preferably provided that the angle R lies in a range of 100 to 600 inclusive, in particular to direct a surge of the fuel as early as in the flow direction. In addition, it is provided that the respective, preferably circular exit opening 70 that is for example designed as a hole has a diameter, in particular an inner diameter, that lies in a range of 50 mm to 3 mm inclusive.

Figure 15:
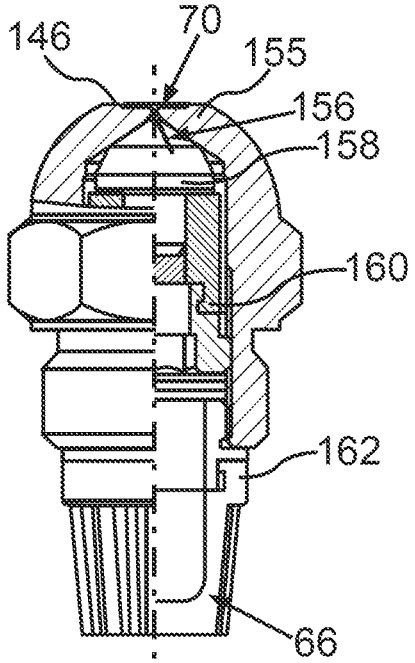
FIG. 15 shows a schematic and partially sectional side view of an injection element of the burner.

FIG. 15 shows a possible further embodiment of the injection element 66 in a schematic and partially sectional side view. In the exemplary embodiment shown in FIG. 15, the injection element 66 is designed as an injection nozzle, as is used in fuel oil burners. In the exemplary embodiment shown in FIG. 15, the injection element 66 has a head 155, a swirl slit 156, a vortex body 158, a secondary filter 160 and a primary filter 162. The injection element 66 according to FIG. 15 has at least or exactly one exit opening 70, wherein the exit opening 70 of the injection element 66 is designed or formed on its axial end face 146, which is also described as an axial end surface. This means that the fuel jet 72 flowing through the exit opening 70 in the axial direction of the injection element 66, and thus of the respective swirl chamber 62 or 76, exits the exit opening 70, and thus the injection element 66. In other words, according to FIG. 15, the fuel jet 72 or its longitudinal axis or longitudinal central axis runs at least substantially in the axial direction, i.e., in parallel with the axial direction of the respective swirl chamber 62 or 76.

Figure 16:
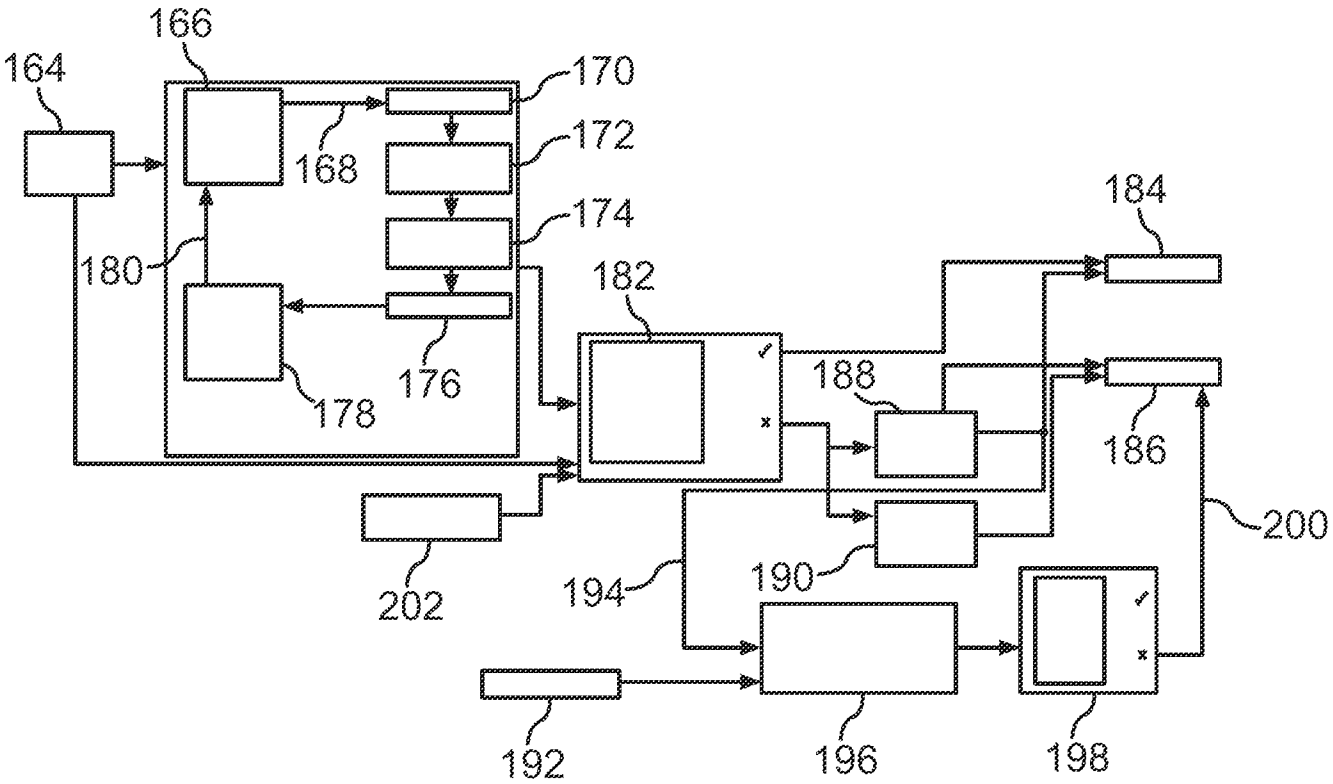
FIG. 16 shows a block diagram to depict an operation of the burner 42.

FIG. 16 shows a block diagram for depicting an operation, in particular a regulation of the burner 42. A temperature of the exhaust gas at the introduction point E2 or downstream of the introduction point E2 and in particular upstream of the component 36*b* is labelled T5. For example, the temperature T5 is measured, in particular by means of a temperature sensor, such that for example a value, also described as a T5 value, that characterizes the temperature T5 is measured. The T5 value is depicted by a block 164 in FIG. 16. The T5 value is transferred to a block 166, in particular as an input parameter. The block 166 depicts an initial state in which, for example, an air feed into the burner 42 is closed, the fuel pump is deactivated, such that a fuel feed into the burner 42 is also deactivated and the ignition device 60 is deactivated. An arrow 168 depicts a so-called burner release, i.e., a release of the burner. As a consequence of the burner release, the ignition device 60 is switched on, i.e., activated, in a block 170. In a block 172, a fuel-air ratio of the mixture of 0.9 is for example set to thus obtain a starting operation of the burner 42. In addition, in the block 172, the air pump is for example activated and the fuel pump is activated. The fuel-air ratio of the mixture is then adjusted to 1.03 in a block 174, for example, wherein the fuel pump is operated at a low frequency. In a block 176, the ignition device 60 is for example deactivated. A block 178 depicts an operating state of the burner 42. In the operating state, an air feed to or into the burner 42 is opened, and the fuel pump is switched on and the ignition device 60 is deactivated such that the burner 42 is supplied with the air and the fuel. An arrow 180 indicates that the burner release is withdrawn, in particular if the temperature T5 is greater than a limit value that is 400° C., for example.

In a block 182, a comparison in which an actual value of the temperature T5 is compared with a target value of the temperature T5 is implemented. The actual value of the temperature T5 is for example the previously specified T5 value, and/or for example the actual value of the temperature T5 is measured, in particular by means of the previously specified temperature sensor, in particular at the introduction point E2 or at a point in the exhaust gas tract 26 arranged downstream of the introduction point E2, and in particular upstream of the component 36*b*. If, for example, the comparison yields that the actual value is less than or equal to the target value, then a state adjusted in particular in the block 174 is maintained, in particular with regard to the operation of the fuel pump and the air pump, wherein the fuel pump is depicted in FIG. 16 by a block 184 and the air pump by a block 186. If, for example, the actual value is greater than the target value, then in the block 188, a control of the fuel pump is implemented, in particular by means of an electronic computer also described as a control device, and/or a control of the air pump is implemented in a block 190, in particular via the control device, in particular continuously, such that the fuel pump or the air pump is changed with regard to its respective operation, in particular such that the actual value is reduced, until for example the actual value corresponds to the target value or is smaller than the target value.

In a block 192, the quantity of the air of the mixture is determined, in particular measured, in particular via an air flow measurement. It is additionally depicted via an arrow 194 that the quantity of the fuel is determined, in particular measured. In a block 196, the fuel-air ratio (γ) is determined, in particular calculated, depending on the determined, in particular measured quantity of the air and depending on the determined, in particular measured or calculated quantity of the fuel. In particular, in the block 196, an actual value of the fuel-air ratio of the mixture is determined, in particular calculated. In a block 198, the actual value of the fuel-air ratio is compared with a second target value of the fuel-air ratio, wherein the second target value is for example 1.03. If the actual value of the fuel-air ratio corresponds to the target value of the fuel-air ratio, or if the actual value of the fuel-air ratio deviates from the target value of the fuel-air ratio only such that a difference between the actual value of the fuel-air ratio and the target value of the fuel-air ratio is in particular larger in magnitude or equal to a limit, then a current operation of the burner 42, in particular of the fuel pump and of the air pump is maintained. If, however, the actual value of the fuel-air ratio deviates excessively from the target value of the fuel-air ratio, then, as depicted in particular by an arrow 200, the air pump and/or the fuel pump is changed with regard to its respective operation, in particular by controlling the fuel pump or the air pump, in particular such that the difference between the actual value of the fuel-air ratio and the target value of the fuel-air ratio is at least reduced or even eliminated. Finally, a block 202 depicts that the target value of the temperature T5 is predetermined by or from the control device, in particular in the block 182. As an alternative or in addition, the control device can predetermine or emit the target value of the fuel-air ratio, in particular in the block 198.

It can be seen that the low-pressure pump 20 is used as a fuel pump, by means of which the fuel is fed to and in particular through the injection element 66, to thus inject the fuel, in particular directly, into the inner swirl chamber 62 via the injection element 66. The low-pressure pump 20 has a dual function, as it is used on the one hand, for example, to feed the propellant to the injection element 66 as the fuel, and on the other hand to feed the propellant out of the tank 18 to the high-pressure pump 22. As an alternative, it would be conceivable to use a fuel pump specifically provided for the burner 42, i.e., to use such a fuel pump by means of which the fuel can be or is, in particular actively, fed as the propellant from the tank 18 to the burner 42, wherein however no propellant can be fed from the tank 18 to the high-pressure pump 22 by means of this dedicated fuel pump. The fuel pump 137 designed for example as a piston pump can thus be used, by means of which the fuel can additionally and in particular be fed through the injection element 66.

Figure 18:
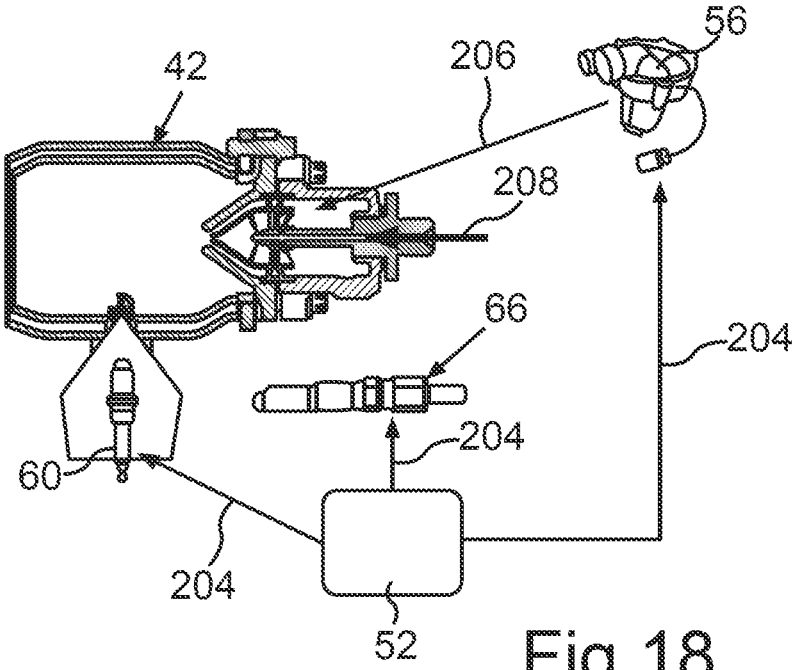
FIG. 18 shows a system image to depict a method for operating the burner.

FIG. 18 shows a system image for depicting the burner 42 and in particular for depicting a method for operating the burner 42. Via arrows 204, it is depicted in FIG. 18 that the electronic computer 52 can control the air pump 56, the injection element 66 and the ignition device 60, in particular electrically. As an alternative or in addition, the electronic computer 52 can control the fuel pump, in particular electrically. The previously specified air conduit, and thus the air supply journey 54, is depicted by an arrow 206. In other words, the air supply path 54 is or comprises at least one air conduit by means of which the air can be introduced into the respective swirl chamber 62 or 76 or into the air chamber 92, in particular tangentially or obliquely to the axial direction of the respective swirl chamber 62 or 76. In addition, an arrow 208 depicts a or the previously specified propellant conduit also described as a fuel conduit via which the injection element 66 can be provided with the fuel. In particular, the arrow 208 thus depicts the fuel supply path 46 and/or the conduit 68.

Controlling the injection element 66 can for example be understood to mean that a valve element of the injection element 66 can be or is displaced between at least one closed position and at least on open position by controlling the injection element 66. In the closed position, the valve element blocks the exit openings 70, for example, and in the open position, the valve element releases the exit openings 70, for example. As an alternative or in addition, controlling the injection element 66 can be understood to mean a or the previously described control of the fuel pump, e.g., of the piston pump 136 that can in particular be operated electrically.

To obtain a particularly efficient and effective operation of the burner 42—as has already been indicated with regard to FIG. 16—a first quantity of the air, also described as an air quantity, that is fed to the swirl chambers 62 and 76, in particular actively, or supplied to the swirl chambers 62 and 76, in particular actively, is determined by means of the electronic computer 52 (control device). Actively feeding the air to or into the swirl chambers 62 or 76 should be understood to mean that the air is actively fed by means of the air pump 56, in particular via electrically operating the air pump 56, and is thus fed to and into the swirl chambers 62 and 76. In addition, a second quantity of the fuel, also described as a fuel quantity, is determined by means of the electronic computer 52 and is fed to the injection element 66, in particular actively, or is supplied to the injection element 66, in particular actively. Actively feeding the fuel to the injection element 66 should in particular be understood to mean that the fuel is fed by means of the fuel pump, in particular by electrically operating the fuel pump, and is additionally fed through the injection element 66, and is in particular injected into the inner swirl chamber 62 via the injection element 66.

Depending on the air quantity and depending on the fuel quantity, at least one actual value of the fuel-air ratio is determined, in particular calculated, by means of the electronic computer 52. In addition, the burner 42 is operated depending on the determined actual value by means of the electronic computer 72, in particular such that the electronic computer 52 controls the air pump 56 and/or the injection element 66 and/or the fuel pump and/or the ignition device 60, in particular electrically and/or depending on the determined actual value. This is implemented in particular such that the actual value is compared with the target value, in particular by means of the electronic computer 52. The electronic computer 52 operates the burner 42 depending on the comparison of the actual value with the target value of the fuel-air ratio, whereby a particularly advantageous lambda control of the burner 42 can be represented.

As an alternative or in addition, it can be provided that the fuel is injected by means of the injection element 66 into the inner swirl chamber 62, in particular directly, to start the initially deactivated burner 42 during a first period of time, whereby an active supply of the swirl chambers 62 and 76 with the air, i.e., with the lines of air, and an ignition in the combustion chamber 58 cease throughout the first period of time. After the first period of time, i.e., for example during a second period of time immediately or directly following the first period of time, the swirl chambers 62 and 76 are actively supplied with the air, the fuel is injected into the inner swirl chamber 62 by means of the injection element 66 during or within the second period of time, and the mixture is ignited and combusted in the combustion chamber 58 during or within the second period of time. The initially deactivated burner 42 can thus be particularly quickly and efficiently started, in particular in the context of a cold start and/or in cold environment conditions.

The invention claimed is:

1. A method for operating a burner (42) of a motor vehicle having an exhaust gas tract (26) that is flowable through by exhaust gas of an internal combustion engine (12), the burner (42) comprising:

a combustion chamber (58) in which a mixture comprising air and a liquid fuel is ignitable and combustible;

an inner swirl chamber (62) that is flowable through by a first part of the air and that causes a turbulent flow of the first part of the air, wherein the inner swirl chamber (62) has a first outflow opening (64) that is flowable through by the first part of the air flowing through the inner swirl chamber (62) and via which the first part of the air is removable from the inner swirl chamber (62);

an introduction element (66) that has an exit opening (70) that is flowable through by the liquid fuel and that is disposed in the inner swirl chamber (62), wherein via the introduction element (66) the liquid fuel is introducible into the inner swirl chamber (62) via the exit opening (70), wherein the first outflow opening (64) of the inner swirl chamber is flowable through by liquid fuel that has exited the introduction element (66) via the exit opening (70) and has been introduced into the inner swirl chamber (62); and an outer swirl chamber (76) that surrounds at least one longitudinal region of the inner swirl chamber (62) in a peripheral direction of the inner swirl chamber (62), wherein the outer swirl chamber (76) is flowable through by a second part of the air and causes a turbulent flow of the second part of the air, wherein the outer swirl chamber (76) has a second outflow opening (80) that is flowable through by the second part of the air flowing through the outer swirl chamber (76), by liquid fuel flowing through the first outflow opening (64), and by the first part of the air flowing through the inner swirl chamber (62) and the first outflow opening (64), and wherein the first part of the air and the second part of the air and the liquid fuel are introducible into the combustion chamber (58) via the second outflow opening (80);

and comprising the steps of:

introducing the liquid fuel into the inner swirl chamber (62) by the introduction element (66) over a period of time;

ceasing active supply of the inner swirl chamber (62) and the outer swirl chamber (76) with the air and ignition in the combustion chamber for the period of time such that a pre-storage of the liquid fuel in the inner swirl chamber (62) is obtained; and after the period of time, actively supplying the inner swirl chamber (62) and the outer swirl chamber (76) with the air, introducing the liquid fuel into the inner swirl chamber (62) by the introduction element, and igniting and combusting the mixture in the combustion chamber (58).

2. The method according to claim 1, wherein the period of time lasts for at least 0.3 seconds.

3. The method according to claim 1, wherein the period of time lasts for 6 seconds at most.

4. The method according to claim 1, further comprising the steps of, by an electronic computer (52), at least after the period of time:

determining a first quantity of the air and a second quantity of the liquid fuel;

depending on the first quantity and the second quantity, determining an actual value of a fuel-air ratio of the mixture; and operating the burner (42) depending on the determined actual value.

5. The method according to claim 4, wherein the electronic computer (52) controls the introduction element (66) depending on the determined actual value, and thus, operates the burner (42) depending on the determined actual value.

6. The method according to claim 4, further comprising the step of comparing the actual value with a target value by the electronic computer (52), and depending on the comparing, operating the burner (42).

7. The method according to claim 1, further comprising the steps of:

actively feeding the air to the inner swirl chamber (62) and the outer swirl chamber (76) by an air pump (56); and actively feeding the liquid fuel to and through the introduction element (66) by a fuel pump (136).

8. The method according to claim 7, wherein the fuel pump (136) is a piston pump.

9. The method according to claim 7, further comprising the steps of, by an electronic computer (52), at least after the period of time:

determining a first quantity of the air and a second quantity of the liquid fuel;

depending on the first quantity and the second quantity, determining an actual value of a fuel-air ratio of the mixture; and operating the burner (42) depending on the determined actual value;

wherein the electronic computer (52) controls the air pump (56) and the fuel pump (136) depending on the determined actual value.

10. A method for operating a burner (42) of a motor vehicle having an exhaust gas tract (26) that is flowable through by exhaust gas of an internal combustion engine (12), the burner (42) comprising:

a combustion chamber (58) in which a mixture comprising air and a liquid fuel is ignitable and combustible;

an inner swirl chamber (62) that is flowable through by a first part of the air and that causes a turbulent flow of the first part of the air, wherein the inner swirl chamber (62) has a first outflow opening (64) that is flowable through by the first part of the air flowing through the inner swirl chamber (62) and via which the first part of the air is removable from the inner swirl chamber (62);

an introduction element (66) that has an exit opening (70) that is flowable through by the liquid fuel and that is disposed in the inner swirl chamber (62), wherein via the introduction element (66) the liquid fuel is introducible into the inner swirl chamber (62) via the exit opening (70), wherein the first outflow opening (64) of the inner swirl chamber is flowable through by liquid fuel that has exited the introduction element (66) via the exit opening (70) and has been introduced into the inner swirl chamber (62); and an outer swirl chamber (76) that surrounds at least one longitudinal region of the inner swirl chamber (62) in a peripheral direction of the inner swirl chamber (62), wherein the outer swirl chamber (76) is flowable through by a second part of the air and causes a turbulent flow of the second part of the air, wherein the outer swirl chamber (76) has a second outflow opening (80) that is flowable through by the second part of the air flowing through the outer swirl chamber (76), by liquid fuel flowing through the first outflow opening (64), and by the first part of the air flowing through the inner swirl chamber (62) and the first outflow opening (64), and wherein the first part of the air and the second part of the air and the liquid fuel are introducible into the combustion chamber (58) via the second outflow opening (80);

and comprising the steps of:

by an electronic computer (52):

determining a first quantity of the air and a second quantity of the liquid fuel;

depending on the first quantity and the second quantity, determining an actual value of a fuel-air ratio of the mixture; and operating the burner (42) depending on the determined actual value.

* * * * *